US007413498B2

(12) United States Patent
Omata et al.

(10) Patent No.: US 7,413,498 B2
(45) Date of Patent: Aug. 19, 2008

(54) LAPPING APPARATUS AND LAPPING METHOD

(75) Inventors: Masahiro Omata, Yokohama (JP); Masahiko Iizumi, Fujisawa (JP); Kiyoshi Hasegawa, Yokohama (JP); Takashi Ogino, Yokohama (JP); Tomohiro Kondo, Mishima (JP); Kazuo Takeda, Odawara (JP); Takafumi Watanabe, Yokohama (JP); Yoshiyuki Chida, Yokohama (JP); Yasushi Matsushita, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 304 days.

(21) Appl. No.: 10/772,593

(22) Filed: Feb. 6, 2004

(65) Prior Publication Data

US 2004/0157530 A1 Aug. 12, 2004

(30) Foreign Application Priority Data

| | | |
|---|---|---|
| Feb. 12, 2003 | (JP) | 2003-034064 |
| Feb. 12, 2003 | (JP) | 2003-034088 |
| Feb. 14, 2003 | (JP) | 2003-036701 |
| Mar. 5, 2003 | (JP) | 2003-058954 |
| Mar. 5, 2003 | (JP) | 2003-058964 |
| Mar. 12, 2003 | (JP) | 2003-066595 |

(51) Int. Cl.

| | |
|---|---|
| ***B24B 49/00*** | (2006.01) |
| ***B24B 21/00*** | (2006.01) |
| ***B24B 21/18*** | (2006.01) |

(52) U.S. Cl. ..... 451/5; 451/56; 451/59; 451/62; 451/303; 451/443

(58) Field of Classification Search ..... 451/62, 451/444, 56, 168, 173, 5, 11, 59, 443, 313, 451/303, 51

See application file for complete search history.

(56) References Cited

U.S. PATENT DOCUMENTS

| | | | | |
|---|---|---|---|---|
| 4,525,955 | A * | 7/1985 | Cothrell et al. | 451/296 |
| 4,662,116 | A * | 5/1987 | Erani | 451/65 |
| 4,682,444 | A * | 7/1987 | Judge et al. | 451/49 |
| 4,833,834 | A * | 5/1989 | Patterson et al. | 451/310 |
| 4,993,190 | A * | 2/1991 | Hiyoshi et al. | 451/307 |
| 5,251,404 | A * | 10/1993 | Wasserbaech | 451/303 |
| 6,220,946 | B1 * | 4/2001 | Arnold | 451/307 |
| 6,354,920 | B1 * | 3/2002 | Judge et al. | 451/62 |
| 6,383,063 | B1 * | 5/2002 | Ohashi et al. | 451/303 |
| 6,470,775 | B1 * | 10/2002 | Kohlhase et al. | 82/1.11 |
| 6,742,252 | B1 * | 6/2004 | Santorius et al. | 29/888.08 |
| 7,033,245 | B2 * | 4/2006 | Hasegawa et al. | 451/5 |
| 2004/0166767 | A1 * | 8/2004 | Hasegawa et al. | 451/5 |
| 2004/0166776 | A1 * | 8/2004 | Kondo et al. | 451/28 |

FOREIGN PATENT DOCUMENTS

| | | | |
|---|---|---|---|
| DE | 196 02 974 | A1 | 7/1997 |
| EP | 1 027 956 | A2 | 8/2000 |
| JP | 7-237116 | A | 9/1995 |
| JP | 07-256550 | A | 10/1995 |
| JP | 09-136257 | A | 5/1997 |

* cited by examiner

*Primary Examiner*—Maurina Rachuba
(74) *Attorney, Agent, or Firm*—Foley & Lardner LLP

(57) ABSTRACT

A film feeder (FF1) feeds a film (1), a first drive (20) rotates a work (W), a second drive (30) moves the work (W) relative to the film (1), a shoe set handler (40) handles the shoe set (2) to press the film (1) against the work (W), and a deterioration delayer (C) is configured to delay an abrasivity deterioration of the film (1).

31 Claims, 36 Drawing Sheets

LAPPING APPARATUS AND LAPPING METHOD

BACKGROUND OF THE INVENTION

The present invention relates to a lapping apparatus and a lapping method, and in particular, to a lapping apparatus and a lapping method using a lapping abrasive film hereafter called "lapping film" or "film") as a tool.

Recent spreads of need to high-precision work have called attention to a succeeded ultra finish using a lapping film.

For ultra finish, an abrasive face of a lapping film is pressed on a work with a pushing shoe at the back, and the work is rotated and oscillated to be lapped, as in Japanese Patent Application Laying-Open Publication No. 7-237116.

SUMMARY OF THE INVENTION

The abrasive face of lapping film has a multiplicity of abrasive particles adhering thereto, and tends to be soon blocked, with a resultant deterioration of abrasivity.

The present invention is made with this point in view. It therefore is an object of the invention to provide a lapping apparatus and a lapping method that can cope with such deteriortion.

To achieve the object, according to an aspect of the invention, a lapping apparatus comprises a lapping film, a film feeder configured to feed the film, a first drive configured to rotate a work, a second drive configured to move the work relative to the film, a shoe set, a shoe set handler configured to handle the shoe set to press the film against the work, and a deterioration delayer configured to delay an abrasivity deterioration of the film.

According to another aspect of the invention, a lapping method comprises feeding a lapping film, rotating a work, moving the work relative to the film, handling a shoe set to press the film against the work, and delaying an abrasivity deterioration of the film.

BRIEF DESCRIPTION OF THE DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
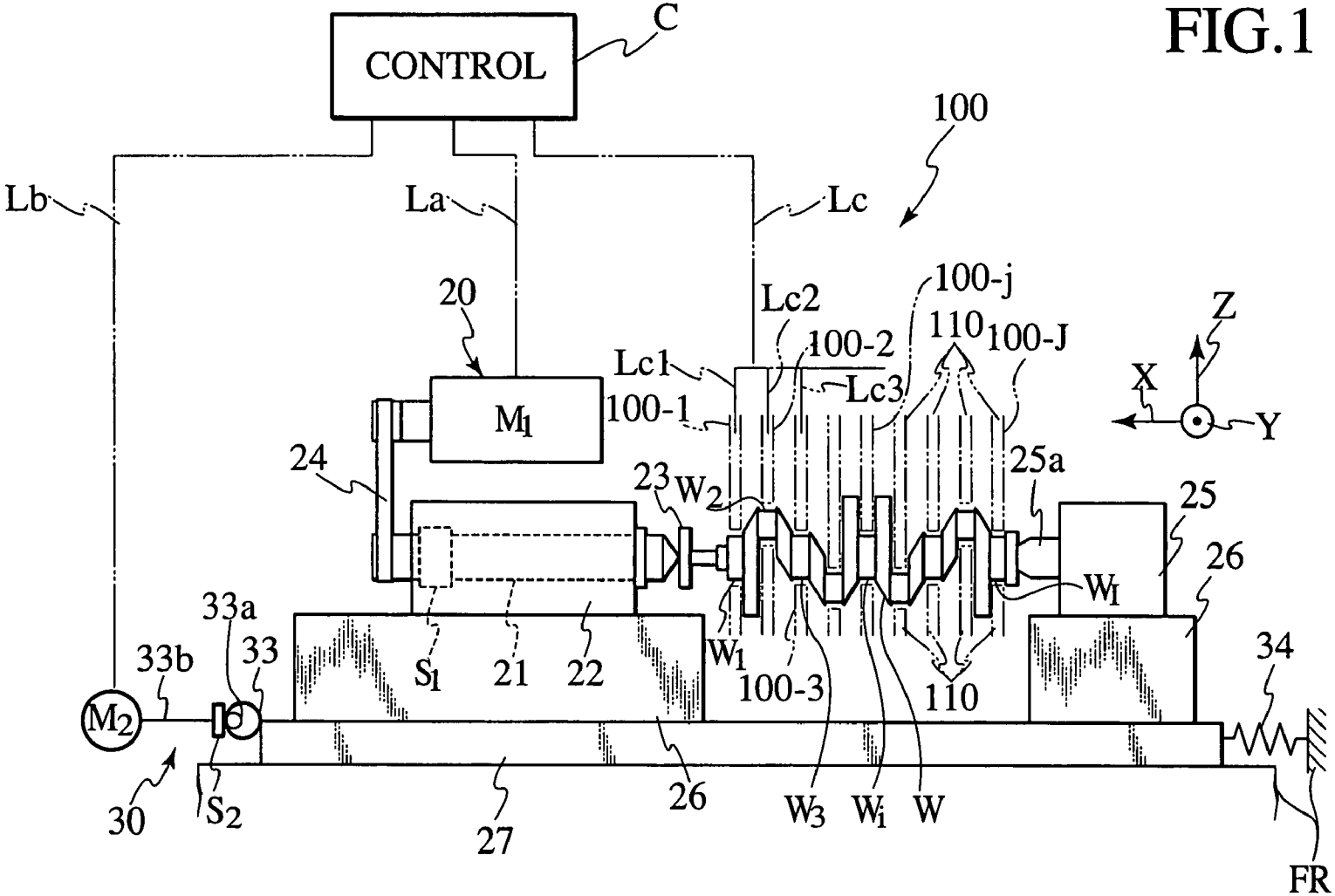
FIG. 1 is a left side elevation of a lapping apparatus according to a first embodiment of the invention.

There will be described below six preferred embodiments of the present invention, as well as modifications of some of them, with reference to the accompanying drawings. Like members or elements are designated by like reference characters.

First Embodiment

Description is now made of a first embodiment of the invention, with reference to FIG. 1 to FIG. 5.

FIG. 1 shows a lapping apparatus 100 as a machine tool according to the first embodiment, in a three-dimensional space defined by an orthogonal X-Y-Z coordinate system, where the apparatus 100 has a machine-longitudinal direction parallel to an X-axis, a machine-transverse direction parallel to a Y-axis, and a machine height along a Z-axis.

The lapping apparatus 100 includes a machine frame FR fixed to a foundation (not shown), a lower table 27 mounted on the frame FR and configured to be longitudinally displaced in a sliding manner relative to the frame FR, and a pair of front and rear upper tables 26 each respectively mounted on the lower table 27 and configured to be transversely displaced in a sliding manner relative to the lower table 27. Tables 26, 27 have their screw-feed systems (not shown) controlled from an NC (numerical controlling) controller C (serving as the brain of an abrasivity deterioration delayer).

The front upper table 26 has a head stock 22 mounted thereon and provided with a spindle 21 rotatable together with a chuck 23. The rear upper table 26 has a tail stock 25 mounted thereon and provided with a center 25*a*. The chuck 23 is adapted to chuck one longitudinal end of a work W (e.g. crankshaft as in FIG. 1), cooperating with the center 25*a* supporting another longitudinal end of the work W, to set this W in position for lapping.

The spindle 21 is driven to rotate from a spindle drive motor M1, via a drive belt 24. The rotation of spindle 1 is detected (in terms of angular displacement and/or angular velocity or rpm (number of revolutions per minute)) by an encoder S1, of which a detection signal is input to the controller C. As the motor M1 is controlled from the controller C via a command line La, the work W is controlled to rotate about its longitudinal axis between the chuck 23 and the center 25*a*.

Accordingly, the work W is driven into rotation by "an operatively connected combination of motor M1, belt 24, and spindle 21" constituting an NC-controlled transversely rotary drive mechanism 20, which may include encoder S1, and involve chuck 23 and center 25*a* to constitute a work holder.

The lower table 27 is normally biased frontward, by a set of springs 34 as parallel resilient members compressed between a rear edge of the table 27 and an opposing member of the machine frame FR, so that a front edge of the table 27 is brought into contact with the circumference of a circular cam 33 fit or fixed on an eccentric drive shaft 33*a*. This shaft 33*a* is driven to rotate from a drive motor M2, via a gearset 33*b*. The rotation of shaft 33*a* is detected (in terms of angular displacement and/or angular velocity or rpm) by an encoder S2, of which a detection signal is input to the controller C. The motor M2 is controlled from the controller C, via a command line Lb. As the cam 33 eccentrically rotates about the shaft 33*a*, the lower table 27 is driven into reciprocal longitudinal movements, together with upper tables 26 and stocks 22, 25 thereon.

Accordingly, the work W held between chuck 23 and center 25*a* is caused to longitudinally oscillate, by "a cooperative combination of motor M2, gearset 33*b*, shaft 33*a*, cam 33, and springs 34" constituting an NC-controlled longitudinally reciprocal or oscillatory drive mechanism 30, which may include encoder S2, upper and lower tables 26, 27, and stocks 22,25.

The oscillation of work W has an amplitude depending on an offset amount of the eccentric shaft 33*a*, i.e., the distance between a geographical center of the cam 33 and a rotation axis of the shaft 33*a*. The number of oscillations per unit time depends on rpm of motor M2, and the instantaneous velocity of oscillation depends on a cosine of the offset amount times the motor rpm. The offset amount may well be adjusted by insertion of a distance piece or adjust plate between the shaft 33*a* and a mount-hole of loose-fit cam 33, or by use of a distance element expansive with a controllable fluid pressure.

The work W may have been molded or rolled, pressed, deformed and/or welded, and cut, milled, drilled and/or ground, as necessary, to be machined (e.g. fine-smoothed or polished for super surfacial finish) at the lapping apparatus 100. The work W has a total number of I (I=predetermined integer) parts {W1 (e.g. journal), W2 (e.g. pin), W3, . . . , Wi (i=arbitrary integer, $1 \leqq i \leqq I$), . . . , WI} to be machined there (at 100), which parts Wi may have their machining conditions different from each other in material, workability, spatial position, peripheral configuration to be curvilinear, and/or surface roughness, for example. In this embodiment, the peripheral configuration is assumed to be circular for comprehension.

The lapping to work W is effected by a longitudinal array of a total number of J (J=predetermined integer, $J \leqq I$) selective and removable or replaceable laps {100-1, 100-2, 100-3, . . . , 100-j (j=arbitrary integer, $1 \leqq j \leqq J$), . . . , 100-J} each respectively constituted with a pair of transversely extending upper and lower laps 110. The J laps 100-j are controllable synchronously or asynchronously from the controller C, via a command line Lc to be branched as necessary (e.g. into branches Lc1, Lc2, Lc3, . . . , Lcj, . . . , LcJ). In this embodiment, it is assumed for comprehension that J=I and the control be synchronous.

Figure 2:
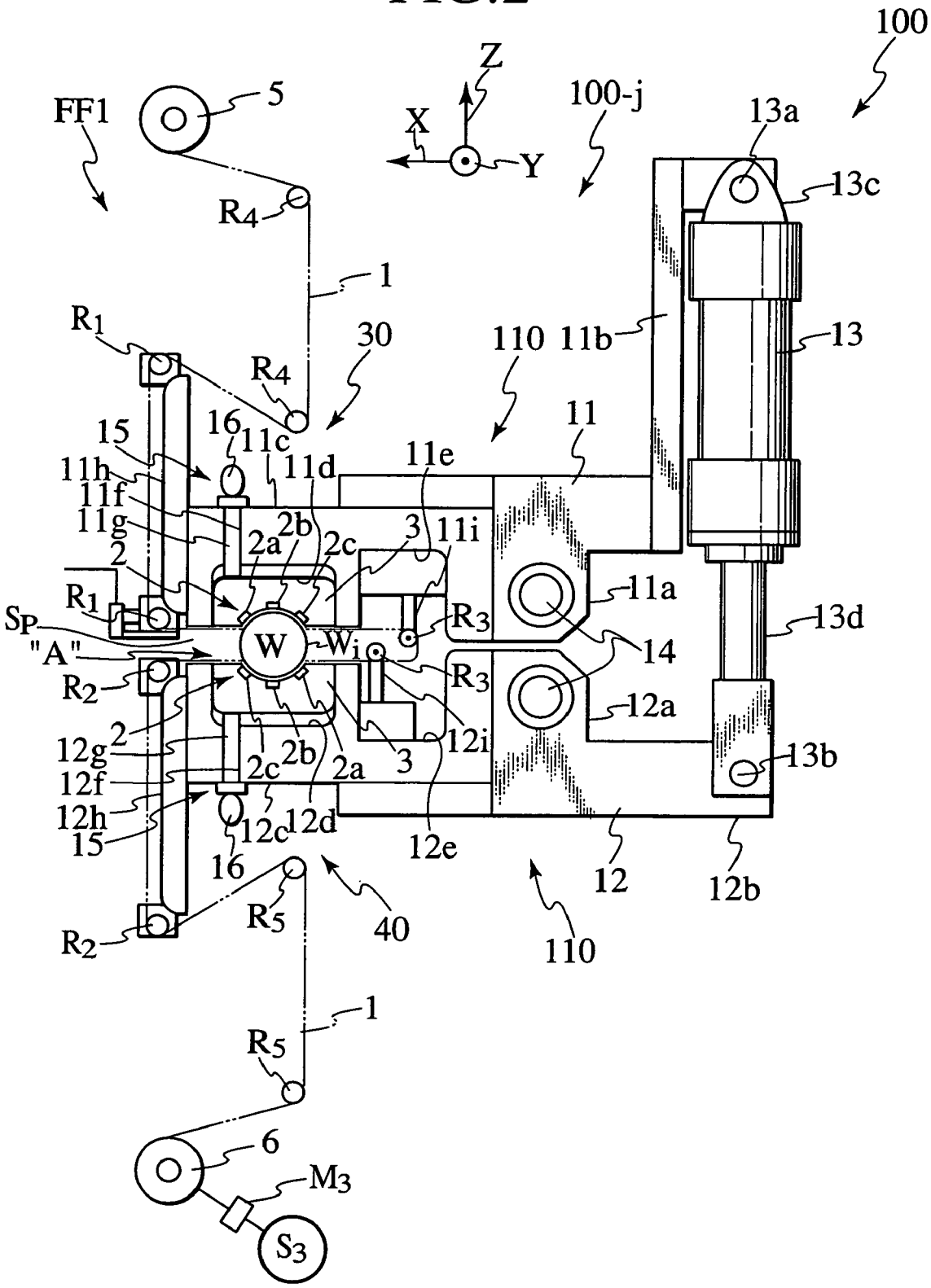
FIG. 2 is a rear view of a close state of a lap of the apparatus of FIG. 1.
Figure 3:
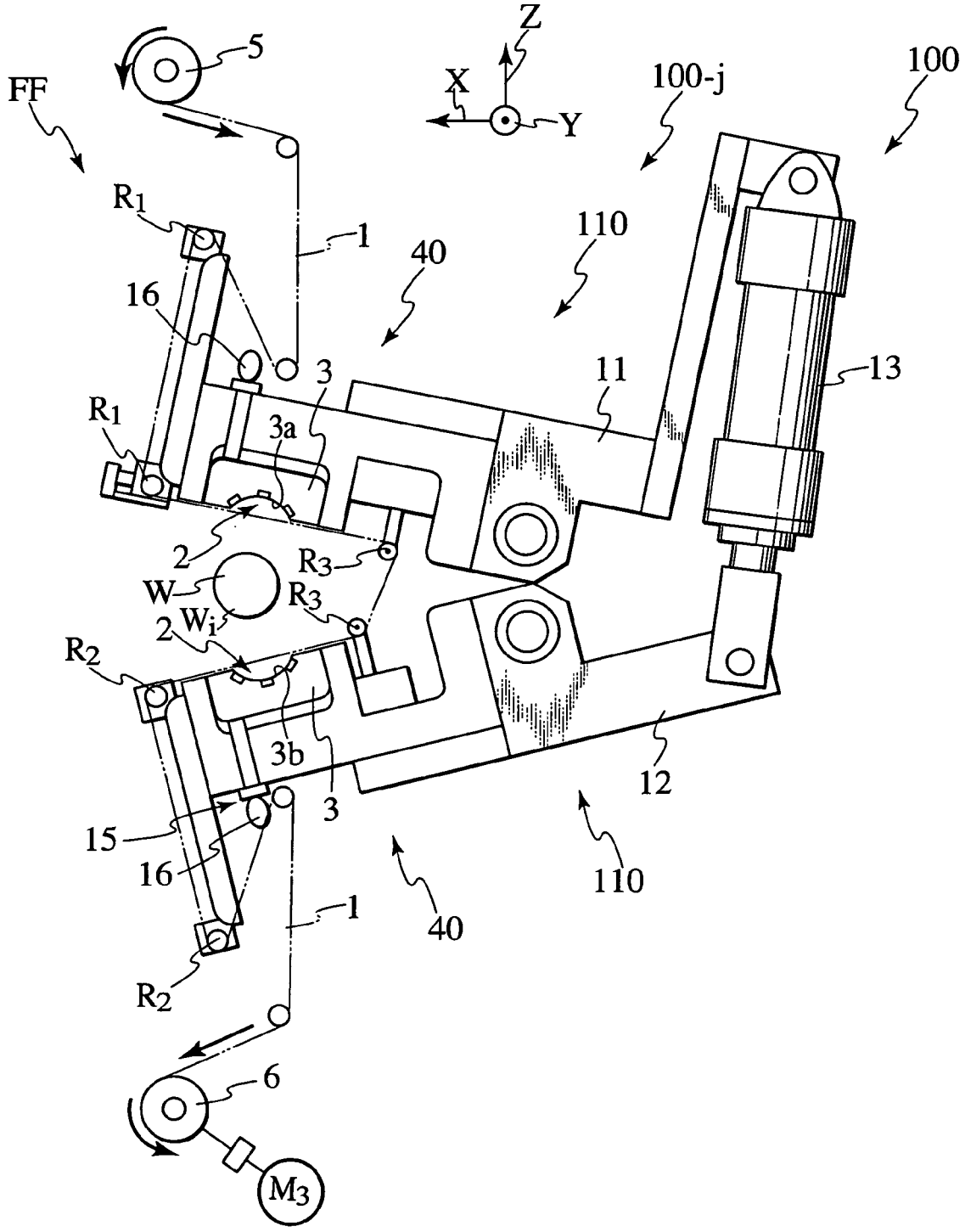
FIG. 3 is a rear view of an open state of the lap of FIG. 2.
Figure 4:
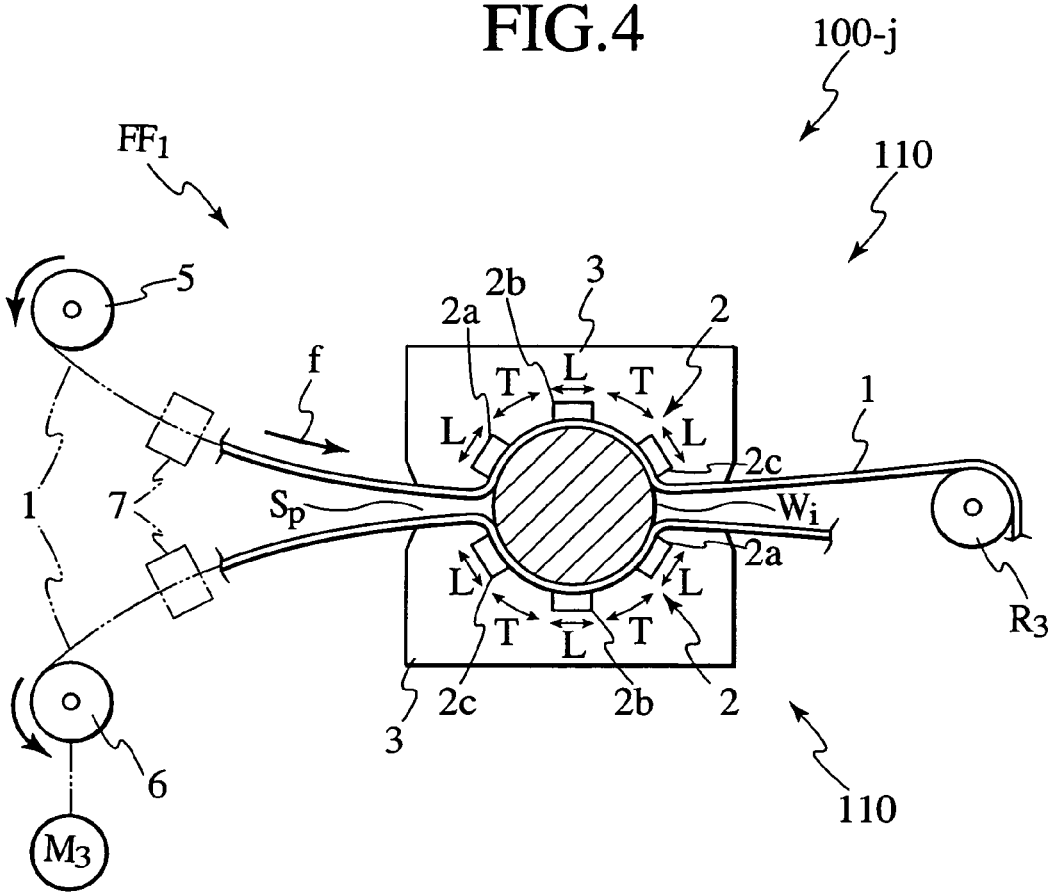
FIG. 4 is a detail "A" of FIG. 2.

FIG. 2 shows a close state of a lap 100-j of the apparatus 100, and FIG. 3, an open state of the lap 100-j. FIG. 4 is a detail "A" of FIG. 2.

The lap 100-j is constituted with the upper and lower laps 110 adapted to cooperatively lap the work part Wi by using fed lengths of a lapping film 1, a film feed system FF1 adapted for controlled feed of the film 1, and a fluid-pressure (e.g. hydraulic or pneumatic) cylinder 13 operable, under control from the controller C, for vertical actuation of the upper and lower laps 110 to be swung CW and CCW about machine-longitudinally extending upper and lower support pins 14, respectively, for open-close operations of lap 100-j. The support pins 14 are fixed to adequate members of the machine frame FR.

The upper and lower laps 110 are configured with machine-transversely extending upper and lower pushing arms 11, 12, respectively. The upper and lower pushing arms 11, 12 are pivoted at their mutually approaching bulged central parts 11*a*, 12*a* on the upper and lower support pins 14. The pushing arms 11, 12 are further pivoted at distal ends of their Z-bent or straight right extensions 11*b*, 12*b* on transversely extending pins 13*a*, 13*b*, which are fixed to a cylinder head 13*a* and a distal end of a piston rod 13*b* of the fluid-pressure cylinder 13.

To serve as pushers for holders (2) of film pressing elements (2), the arms 11, 12 have upper and lower left extensions 11*c*, 12*c*, respectively, which extend beyond an axial centerline of the spindle 21 (FIG. 1), perpendicularly crossing the centerline and the work part Wi in plan view. The upper and lower left extensions 11*c*, 12*c* are formed at their opposing sides respectively with upper and lower left recesses 11*d*, 12*d* for accommodating upper and lower shoe cases 3 (as pressing element holders) to be vertically slidably fit therein, and upper and lower right recesses 11*e*, 12*e* for accommodating upper and lower film rollers R3 to be fixed thereto. The left extensions 11*c*, 12*c* are provided with upper and lower oval cams 16 at their vertically outer sides, and have upper and lower through holes 11*f*, 12*f* formed respectively between the vertically outer sides and bottoms of the upper and lower recesses 11*d*, 12*d*, for insertion of upper and lower push rods 11*g*, 12*g* normally biased to be slid therealong to follow movements of the upper and lower cams 16.

The cams 16 are rotatably fit on support shafts (not shown) fixed to the left extensions 11*c*, 11*d*, and controllable C for rotation to push the shoe cases 3 vertically inward, by manual operations or under NC control of the controller C. Rotation of each cam 16 may be detected and input to the controller C.

The upper and lower shoe cases 3 are formed at their opposing sides with transversely extending upper and lower arcuate recesses 3*a*, 3*b* (FIG. 3), and have a pair of upper and lower sets 2 of transversely extending first, second, and third shoes 2*a*, 2*b*, 2*c* (as film pressing elements) shaped substantially trapezoidal in cross section and embedded in the shoe cases 3, at arcuate intervals T (FIG. 4), to be held by these cases 3, as well as by the arms 11, 12. The shoes 2*a*, 2*b*, 2*c* have their exposed sides shaped arcuate in section, with an arcuate width or arc length L(FIG. 4), to be conformal to corresponding surface regions of work part Wi to be lapped. They 2*a*, 2*b*, 2*c* are made of rubber, synthetic resin, metal (e.g. aluminum) or metal alloy to be sufficiently rigid for the lapping.

Accordingly, in the lap 100-j, each shoe set 2 is conformally pushed against the work part Wi, with the film 1 pressed therebetween, by "a combination of shoe case 3, rod 11*g* or 12*g*, cam 16, arm 11 or 12, cylinder 13, and pin 14" constituting a shoe set handler as a shoe pushing mechanism 40, which includes "a combination of rod 11*g* or 12*g* and cam 16" serving as a pushing force adjuster or regulator 15. Regulator 15 may be replaced by a hydraulic or pneumatic cylinder controlled from the controller C.

The lapping film 1 (refer to FIG. 26) is provided as a reeled length of tape-shaped well-flexible but non-expansive thin layer or lamination (called "substrate") SB having a face Sf as an abrasive front or right side to be pressed against a work part Wi to be lapped, and a back Sb as a smooth rear or wrong side to be pressed by shoes 2, as the shoes 2 are pushed by shoe cases 3 as well as by arms 11, 12. The substrate SB is made of polyester at least at the face Sf (e.g. 1*a* in FIG. 26), and has a thickness within a range of about 25 μm to about 130 μm. Along the length or intermittent lengths at intervals of film 1, the face Sf of substrate SB has uniformly distributed abrasive particles AP (e.g. 1*c* in FIG. 26) embedded therein or attached as adherend thereto by adhesive. The abrasive particles AP are made of an abrasive material (e.g. aluminum oxide, silicon carbide, diamond), and have particle sizes within a range of several μm to about 200 μm. At the back Sb (e.g. 1*b* in FIG. 26), the substrate SB is made of a slip-preventive material (e.g. rubber, synthetic resin), which may be roughed or otherwise processed or treated for slip prevention.

The film feed system FF1 is configured with a film supply reel 5 for releasing lengths of film 1 to be supplied for the lapping, a film take-up reel 6 for winding lengths of film 1 to be taken up past the lapping, and a necessary number of film feed rollers Rk (k=1, 2, 3, 4, 5) for assisting film feed and/or changing film feed direction, without binding or interference. They 5,6, Rk are supported by the frame FR (FIG. 1), upper arm 11, or lower arm 12. The frame FR supports the supply reel 5, take-up reel 6, supply assisting rollers R4, and take-up assisting rollers R5.

The upper and lower arms 11, 12 have a pair of vertically extending and relatively long upper and lower roller support members 11*h*, 12*h* fixed to left ends of their left extensions 11*c*, 12*c*, and a pair of relatively short upper and lower roller support parts 11*i*, 12*i* provided in the upper and lower right recesses 11*e*, of the left extensions 11*c*, 12*c*. The upper support member 11*h* is configured to support a pair of supply side direction changing upper and lower rollers R1 for assisting fed length of film 1 to detour around the upper left extension 11*c* of arm 11, to enter a space Sp between the upper and lower left extensions 11*c*, 12*c*, and to advance in a rightward forward direction in the space Sp or associated gap. The lower support member 12*h* is configured to support a pair of take-up side direction changing upper and lower rollers R2 for assisting fed length of film 1 to retreat in a leftward reverse direction in the space Sp or associated gap, to exit the space Sp, and to detour around the lower left extension 12*c*. The upper and lower support parts 11*i*, 12*i* are configured to support a pair of feed direction changing upper and lower rollers R3 for assisting fed length of film 1 to return in the space Sp.

The film feed system FF1 includes a drive motor M3 for driving the take-up reel 6 to be rotated to wind or take up the film 1 (causing the supply reel 5 to release a length of film 1 to be fed), and a rotary encoder S3 for detecting rotation of the motor M3. The motor M3 is controlled from the controller C via a command line (Lcj) therebetween (refer to FIG. 8). A detection signal of the encoder S3 is input to the controller C. The supply reel 5 may also be driven to rotate by another drive motor provided with a rotary encoder therefor and controlled from the controller C, in synchronism with motor M3.

The film feed system FF1 further includes a pair of upper and lower locking devices 7 (FIG. 4) for locking feeds f of film 1 at the supply side (between reel 5 and roller R4, R1, or R3) and the take-up side (between roller R3, R2, or R5 and reel 6), respectively. The locking devices 7 are controlled from the controller C (FIG. 1), so that the film 1 is tensioned as necessary at the supply side and the take-up side. Like locking devices may be installed between reel 5 and roller R4 or R1 or rollers R1, R3, and between rollers R3, R2 or roller R2 or R5 and reel 6.

As tensioned between rollers R1-R3 and R3-R2, film 1 is stretched straight there, as in FIG. 3 where lap 100-j is open with hydraulic cylinder 13 contracted. When the lap is close with the cylinder 13 expanded as in FIG. 2, the film 1 is pressed between either set 2 of shoes 2*a*, 2*b*, 2*c* and work part Wi, conformally curving with surface regions of work part Wi to be lapped by upper and lower laps 110, as the work W is machine-longitudinally oscillated by drive mechanism 30 (FIG. 1).

In this embodiment, the film feed system FF1 is adapted for a sequence of intermittent feeds of film 1 to utilize interrupting intervals therebetween for a lapping service at each shoe set 2 by the film 1. For effective lapping and efficient use of film 1, the lap 100-j is configured to prohibit a repeated use of film region in each service, by setting ratios of shoe width Land shoe intervals T to feed f, such that:

$$T:L:f=n:1:n,$$

where n is the number of shoes associated with the service, i.e., in either shoe set 2.

Figure 5:
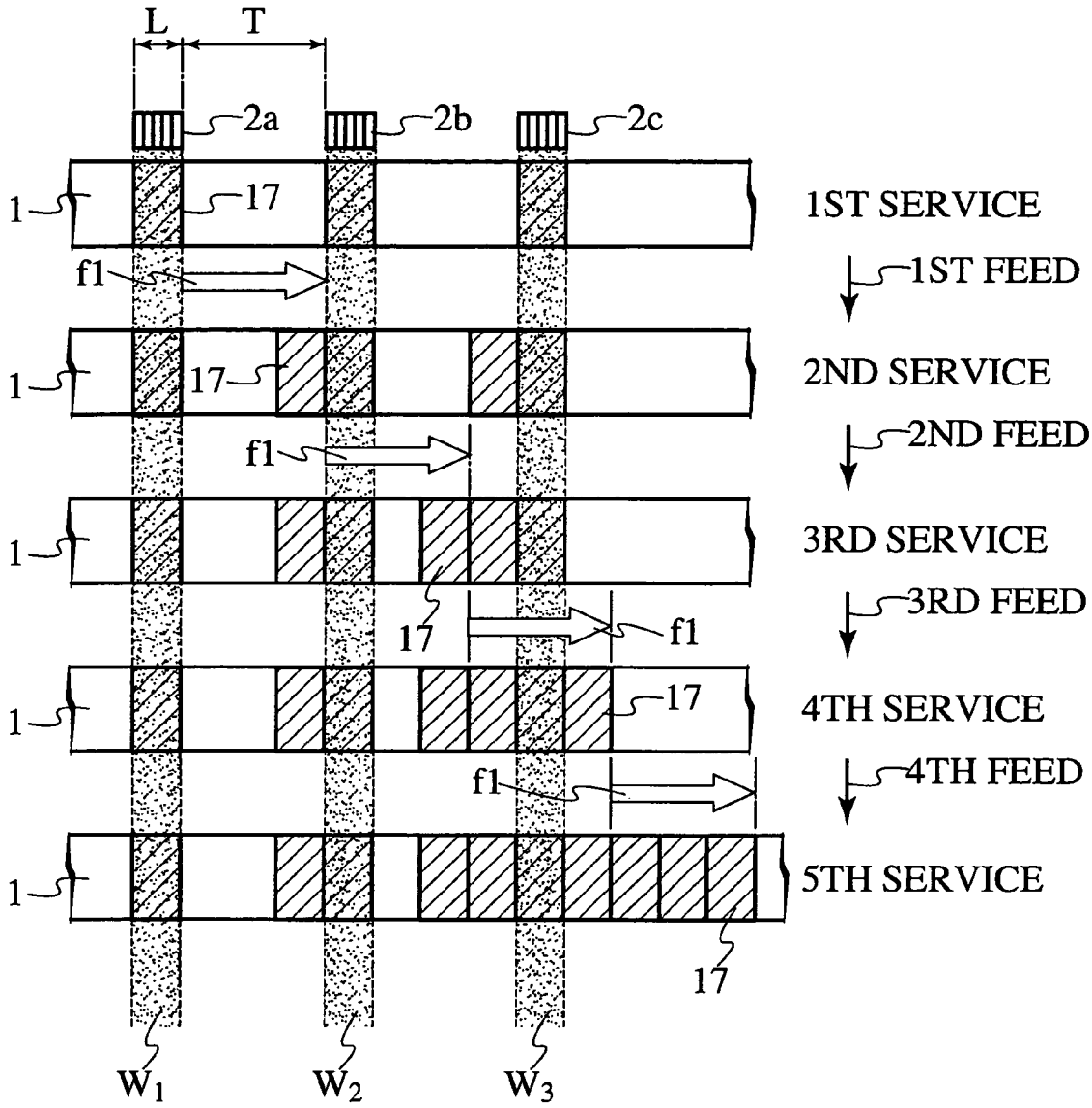
FIG. 5 is a film feed timing chart of the lap of FIG. 2.

FIG. 5 shows a film feed timing at the lap 100-j. For n=3, T=3×L and f=3×L (=f1).

Figure 26:
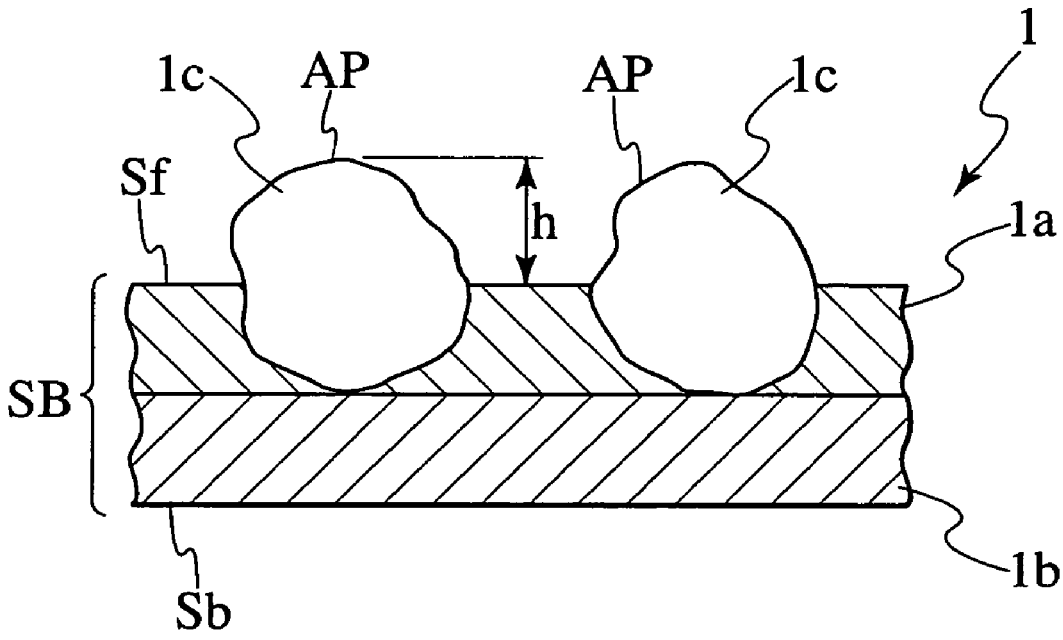
FIG. 26 is a sectional view of a film of the lap of FIG. 24.

In a first service, as work W is oscillated, the first, second, and third shoes 2*a*, 2*b*, 2*c* have first, second, and third dotted working zones $W_p$ (p=1 for 2*a*, p=2 for 2*b*, p=3 for 2*c*) of width L along their arcuate exposed sides, under which the film 1 has shadow regions of width L used for a lapping service at the face Sf (refer to FIG. 26). The first shoe 2*a* covers the first working zone $W_p$ (p=1), and uses a corresponding film region 17, which is now concerned.

After the first service, the film 1 is moved at a distance f1=3×L by a first feed, whereby a right side of the film region 17 is displaced to an adjacent position to a left side of the second working zone $W_p$ (p=2), so that the film region 17 overlaps an L-width zone trailing just behind the second working zone $W_p$ (r=2).

In a second service, just ahead of the above-noted trailing zone, the second shoe 2*b* uses a corresponding new film region for lapping.

After the second service, the film 1 is moved at another distance f1 by a second feed, whereby the right side of film region 17 is displaced to an adjacent position to a left side of a trailing zone just behind the third working zone $W_p$ (p=3), so that the region 17 overlaps an L-width zone trailing after another trailing zone behind the third working zone $W_p$ (p=3).

In a third service, just ahead of the other trading zone, the third shoe 2*c* uses a corresponding new film region for lapping.

After the third service, the film 1 is moved at still another distance f1 by a third feed, whereby the right side of film region 17 is displaced to a position of a right side of a preceding zone just ahead of the third working zone $W_p$ (p=3), so that the region 17 overlaps the preceding zone.

In a fourth service, just behind the above-noted preceding zone, the third shoe 2*c* uses a corresponding new film region for lapping.

After the fourth service, the film 1 is moved at yet another distance f1 by a fourth feed, whereby the right side of film region 17 is displaced to a position of a right side of an exceeding zone ahead of the third working zone $W_p$ (p=3) with connected three L-width zones in between, so that the region 17 overlaps the exceeding zone.

In a fifth service, just behind the above-noted three zones, the third shoe 2*c* uses a corresponding new film region for lapping. It is noted that past the last working zone $W_p$ (p=3), whole film regions are connected without unused regions therebetween, so that the substrate face Sf of film 1 has been fully and one-time used, allowing for uniform lapping service and efficient use of film 1.

First Modification of First Embodiment

Figure 6:
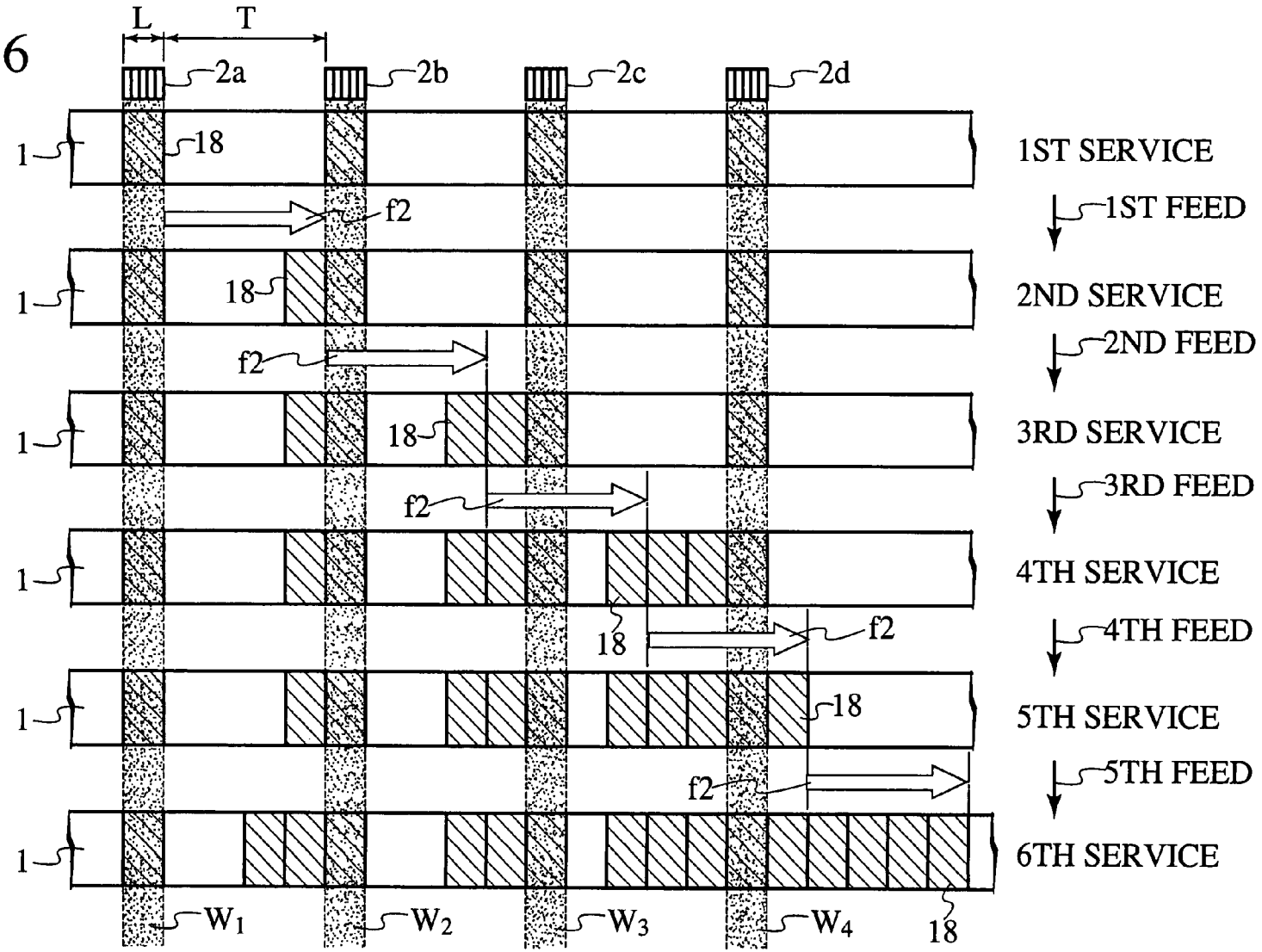
FIG. 6 is a film feed timing chart of a lap of a lapping apparatus according to a first modification of the first embodiment.

FIG. 6 shows a film feed timing at a lap 100-j of a lapping apparatus according to a first modification of the first embodiment, where n=4, T=4×L, and f=4×L(=f2).

In this lap 100-j, each shoe set 2 has four shoes 2*a*, 2*b*, 2*c*, 2*d* covering first, second, third, and fourth dotted working zones $W_q$ (q=1 for 2*a*, q=2 for 2*b*, q=3 for 2*c*, q=4 for 2*d*) of width L along their arcuate exposed sides, under which a film 1 has shadow regions of width L used for a lapping service at the face Sf. In a first service, the first shoe 2*a* covers the first working zone $W_q$ (q=1), and uses a corresponding film region 18, which is now concerned and traced up to a sixth service following a fifth feed.

In this modification, past the last working zone $W_q$ (q=4), whole film regions are connected without unused regions therebetween, so that the substrate face Sf of film 1 has been fully and one-time used, allowing for uniform lapping service and efficient use of film 1.

Second Modification of First Embodiment

Figure 7:
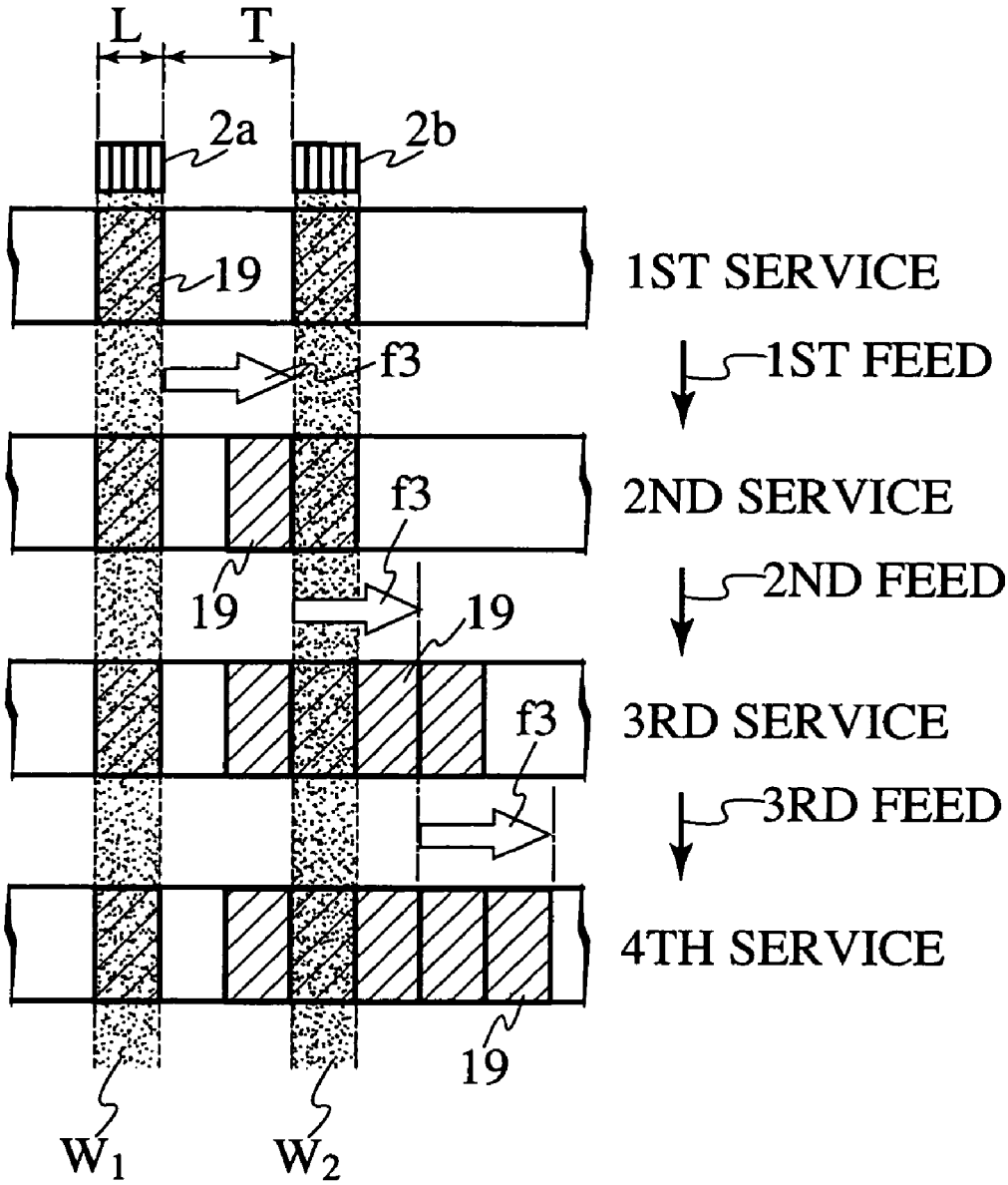
FIG. 7 is a film feed timing chart of a lap of a lapping apparatus according to a second modification of the first embodiment.

FIG. 7 shows a film feed timing at a lap 100-j of a lapping apparatus according to a second modification of the first embodiment, where n=2, T=2×L, and f=2×L(=f3).

In this lap 100-j, each shoe set 2 has two shoes 2*a*, 2*b* covering first and second dotted working zones $W_r$ (r=1 for 2*a*, r=2 for 2*b*) of width L along their arcuate exposed sides, under which a film 1 has shadow regions of width L used for a lapping service at the face Sf. In a first service, the first shoe 2*a* covers the first working zone $W_r$ (r=1), and uses a corresponding film region 19, which is now concerned and traced up to a fourth service following a third feed.

In this modification, past the last working zone $W_r$ (r=4), whole film regions are connected without unused regions therebetween, so that the substrate face Sf of film 1 has been fully and one-time used, allowing for uniform lapping service and efficient use of film 1.

Third Modification of First Embodiment

Figure 8:
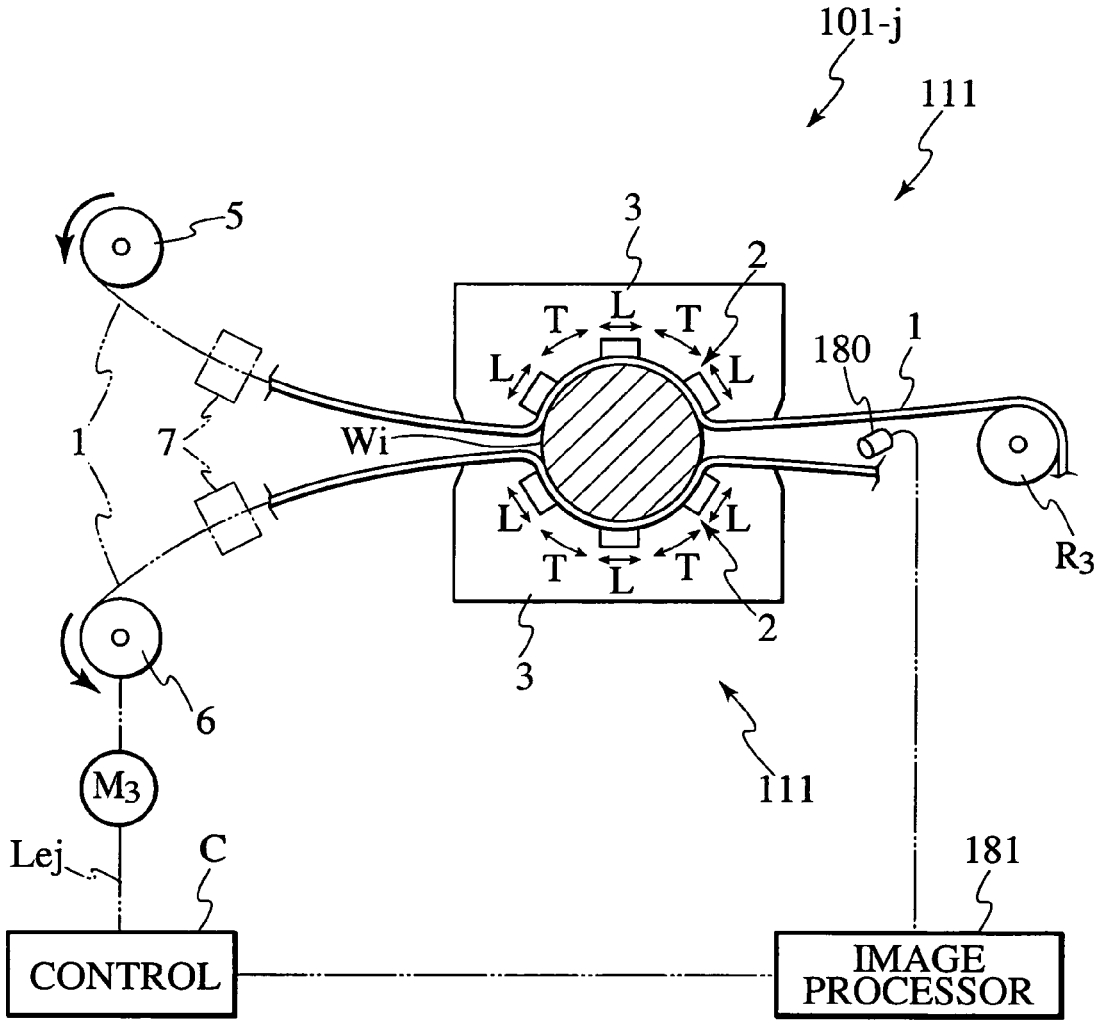
FIG. 8 is a diagram of a lap control system of a lapping apparatus according to a third modification of the first embodiment.

FIG. 8 shows a control system for a lap 101-j of a lapping apparatus according to a third modification of the first embodiment.

This modification is different from the first embodiment 100 in that the substrate face Sf of a film 1 is detected for unused or reusable regions for a lapping service at a shoe set 2 of a lower lap 111 of the lap 101-j, by a camera 180 arranged therefor near a detour of film path between upper and lower shoe cases 3, and that picture data from camera 180 is processed by an image processor 181, to be input to a controller C.

At the controller C, input data is processed for generation of commands to be output via a branch line Lcj to a drive motor M3 of a take-up reel 6, as well as to locking device(s) 7, as necessary to effect a correction of film feed f (FIG. 4), to avoid using (in a service at the shoe set 2 of lower lap 111) more clogged regions than after a reference service at a shoe set 2 of an upper lap 111 of the lap 101-j.

Work W (FIG. 1) may be a camshaft, and work part Wi (FIG. 4) may be a cam lobe. In such a case, film feed is controlled not to reuse once-used regions even at the shoe set 2 of lower lap 2.

Second Embodiment

Figure 9:
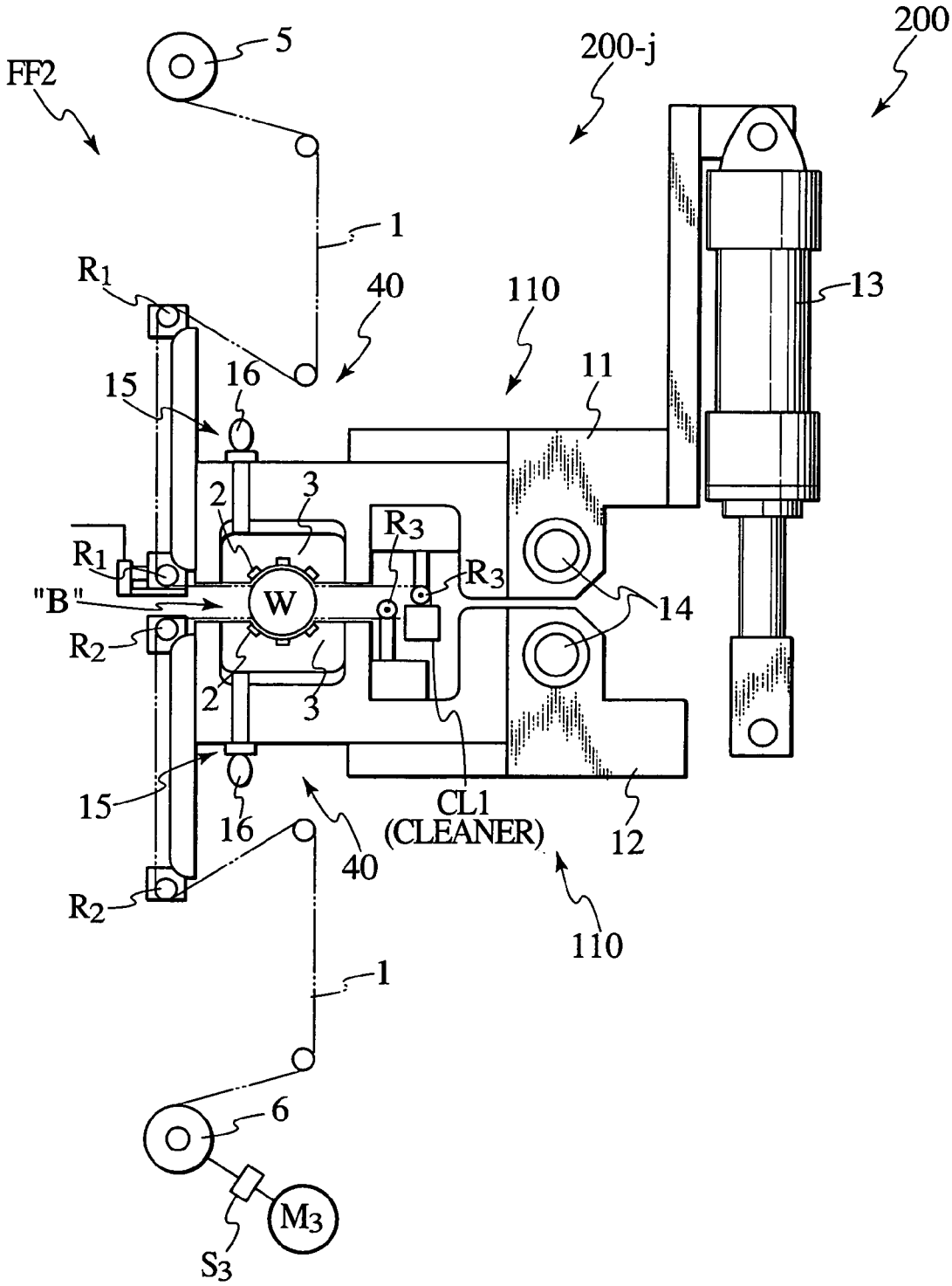
FIG. 9 is a rear view of a close state of a lap of a lapping apparatus according to a second embodiment of the invention.
Figure 10:
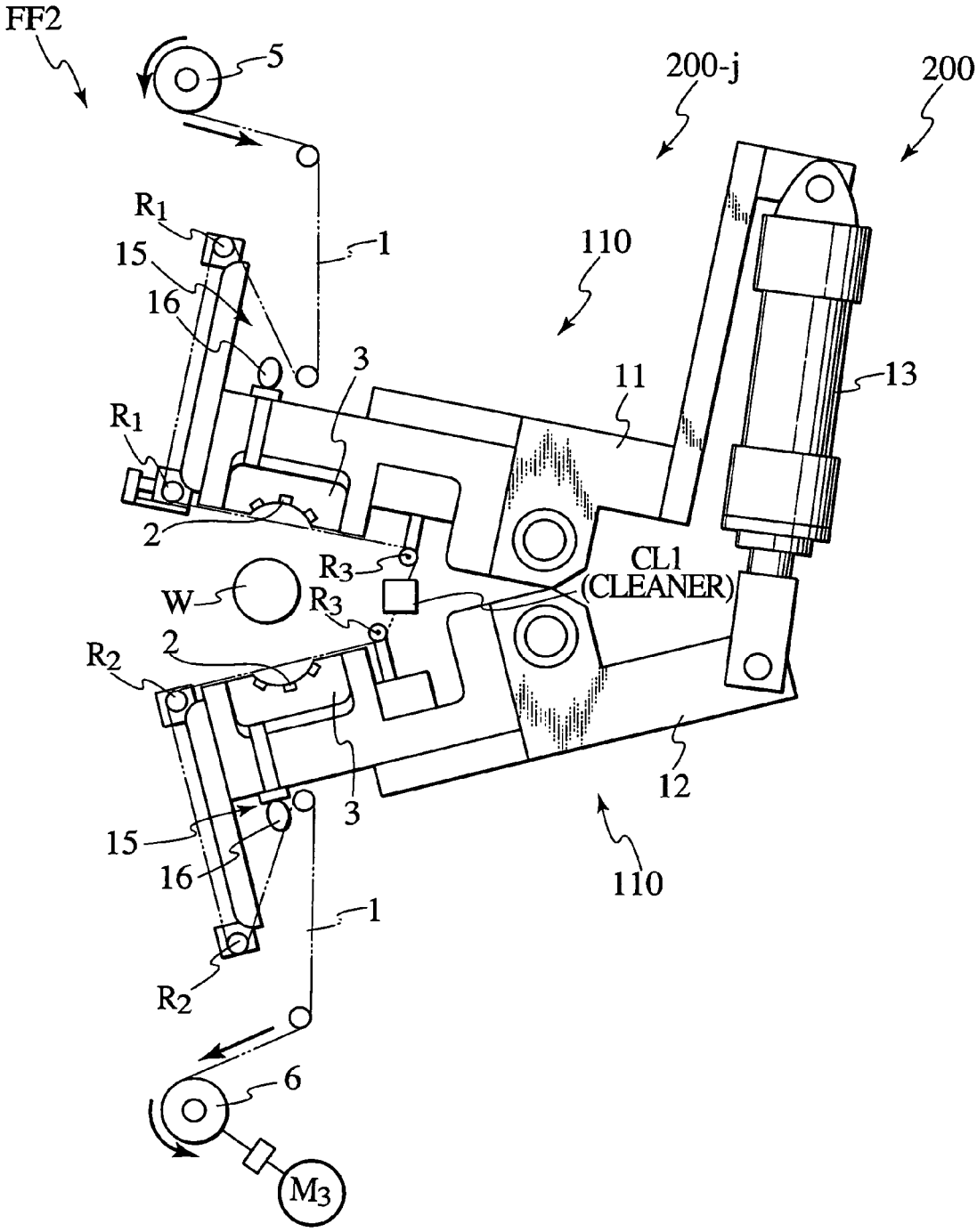
FIG. 10 is a rear view of an open state of the lap of FIG. 9.

Description is now made of a second embodiment of the invention, with reference to FIG. 9 and FIG. 10. FIG. 9 shows a close state of a lap 200-j of a lapping apparatus 200 according to the second embodiment, and FIG. 10, an open state of the lap 200-j.

This embodiment 200 is different from the first embodiment 100 in that a film feed system FF2 has a film cleaner CL1 arranged between upper and lower laps 110 and supported by either lap 110 or frame FR (FIG. 1), allowing for reuse of film 1 and uniform lapping.

The cleaner CL1 is configured to clean the substrate face Sf (refer to FIG. 26) of a lapping film 1 after a lapping service at a shoe set 2 of the upper lap 110, or while the lap 200-j is out of lapping service. On-off timings as well as working conditions of the cleaner CL1 are controlled from a controller C (FIG. 1) after a scan to operational conditions of associated drives. The scan may cover image data of an image processor 181 (FIG. 8) to check the film 1 for clog or foreign matter to be removed by cleaning.

First Modification of Second Embodiment

Figure 11:
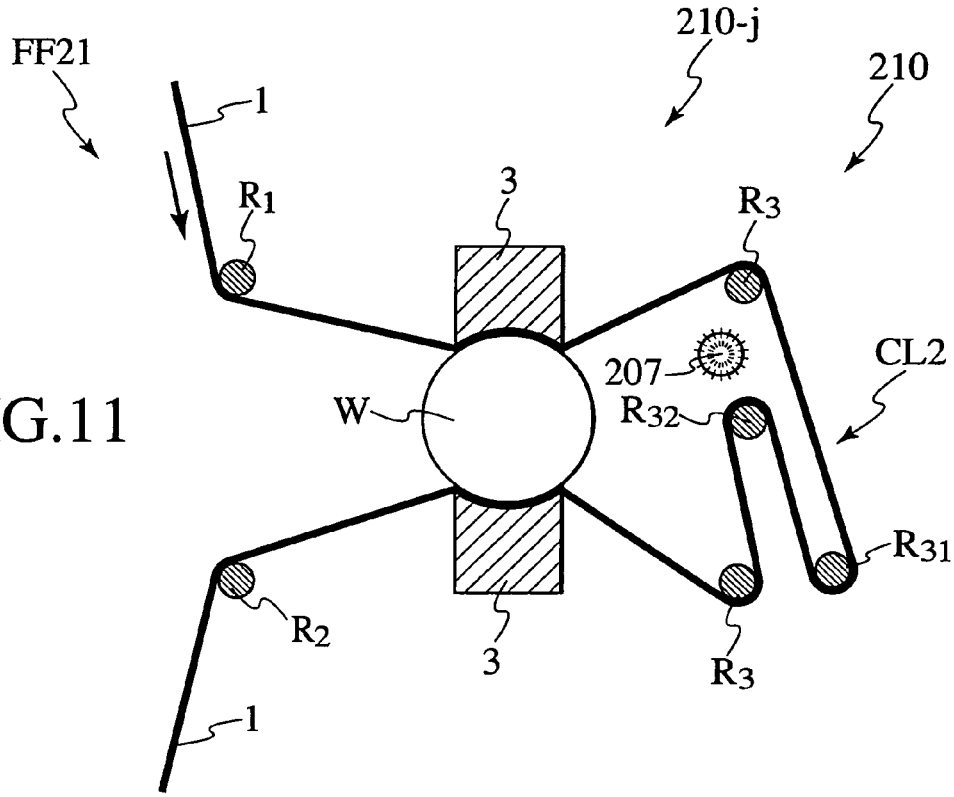
FIG. 11 is a sectional view of a film cleaner of a lap of a lapping apparatus according to a first modification of the second embodiment.

FIG. 11 shows a film cleaner CL2 of a lap 210-j of a lapping apparatus 210 according to a first modification of the second embodiment, and corresponds to a detail "B" of FIG. 9.

This modification is different from the second embodiment 200 in that a film feed system FF21 has a film cleaner C12 comprised of an ultrasonic brush 207, and a detour of film 1 provided over additional film rollers R31, R32 between rollers R3. The roller R31 is located so that the film 1 is curved or raised to be exposed with substrate face Sf outside to be cleaned with ease by the brush 207. Cleaner(s) CL2 may be located to clean film 1 at roller(s) R3, R31, and/or R32.

Second Modification of Second Embodiment

Figure 12:
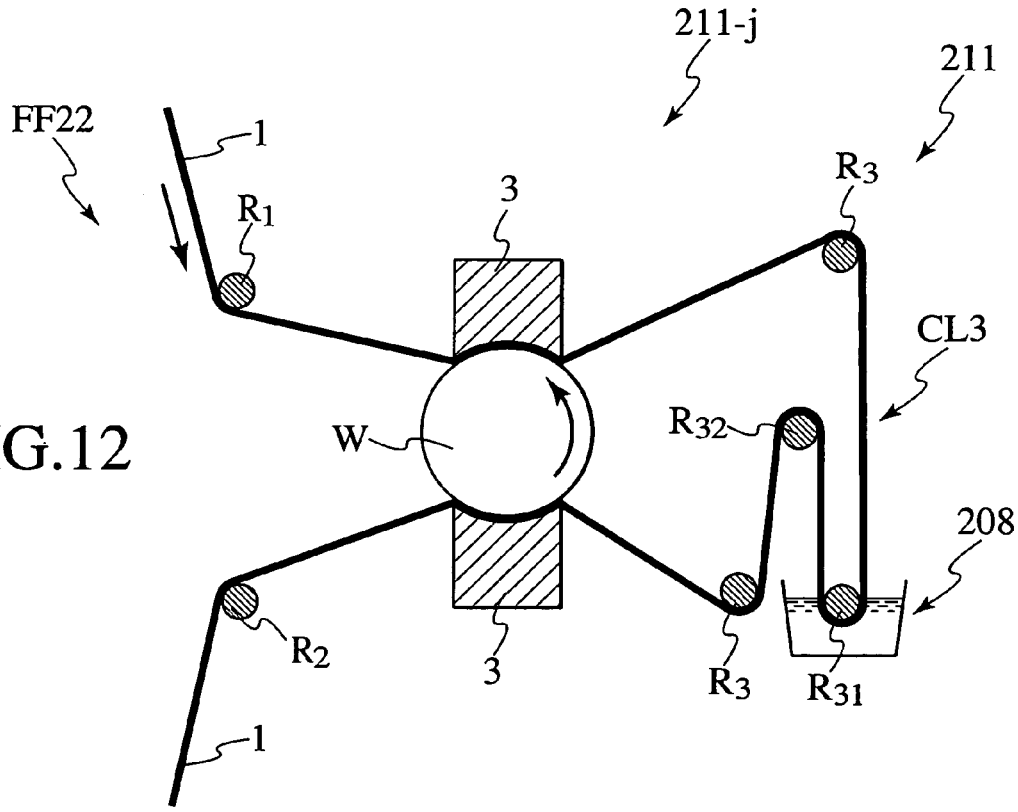
FIG. 12 is a sectional view of a film cleaner of a lap of a lapping apparatus according to a second modification of the second embodiment.

FIG. 12 shows a film cleaner CL3 of a lap 211-j of a lapping apparatus 211 according to a second modification of the second embodiment.

This modification is different from the second embodiment 200 in that a film feed system FF22 has a film cleaner CL3 comprised of an ultrasonic bath 208, and a detour of film 1 provided over additional film rollers R31, R32 between rollers R3. The roller R31 is located so that the film 1 is curved or raised to be dipped with substrate face Sf outside to be cleaned with ease in the bath 208. Cleaning liquid may be a coolant for lapping and supplied from a coolant storage tank. Cleaner(s) CL3 may be located or extended to clean film 1 at roller(s) R3, R31, and/or R32.

Third Modification of Second Embodiment

Figure 13:
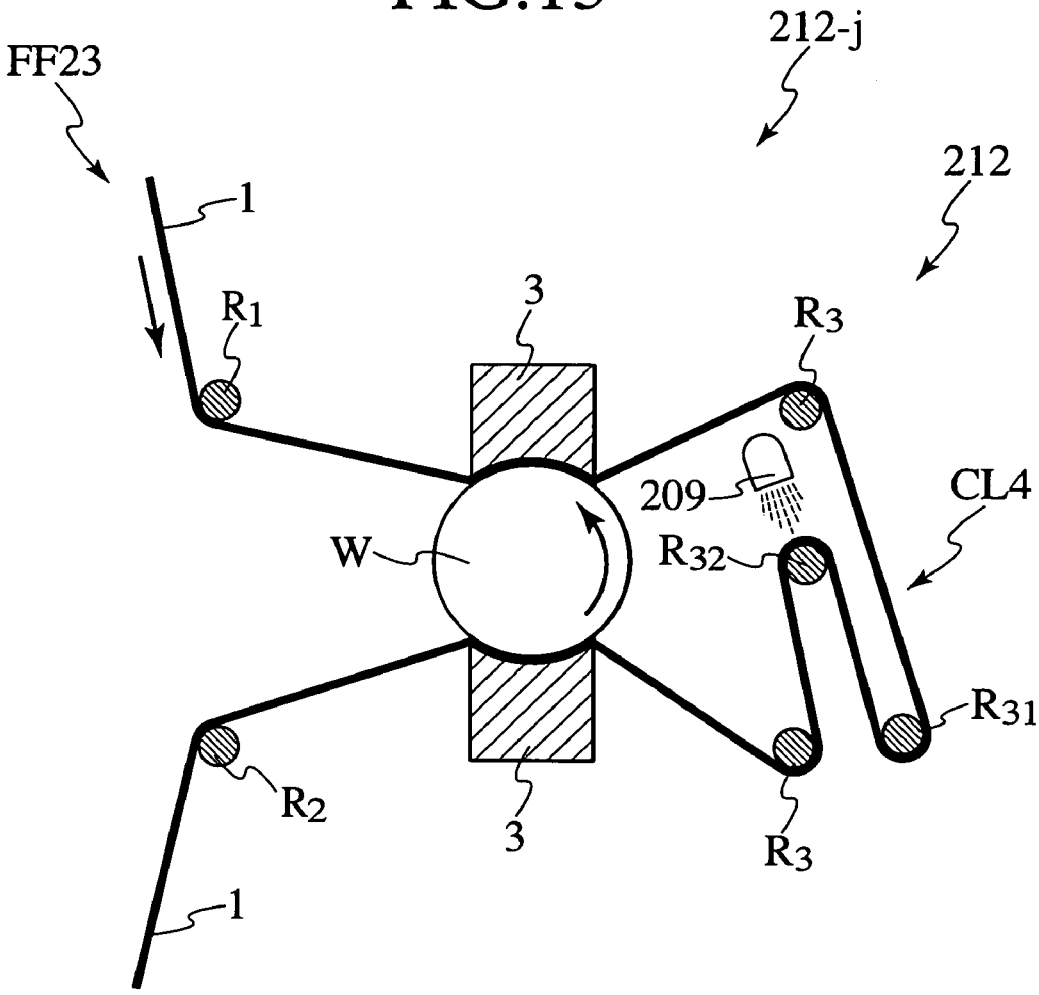
FIG. 13 is a sectional view of a film cleaner of a lap of a lapping apparatus according to a third modification of the second embodiment.

FIG. 13 shows a film cleaner CL4 of a lap 212-j of a lapping apparatus 212 according to a third modification of the second embodiment.

This modification is different from the second embodiment 200 in that a film feed system FF23 has a film cleaner CL4 comprised of a high-pressure jet nozzle 209, and a detour of film 1 provided over additional film rollers R31, R32 between rollers R3. The roller R31 is located so that the film 1 is curved or raised to be exposed with substrate face Sf outside to be cleaned with ease by jets from the nozzle 209. Cleaning liquid to be atomized into jets may be a coolant for lapping and supplied from a coolant storage tank. Cleaner(s) CL4 may be located to clean film 1 at roller(s) R3, R31, and/or R32.

Third Embodiment

Figure 14:
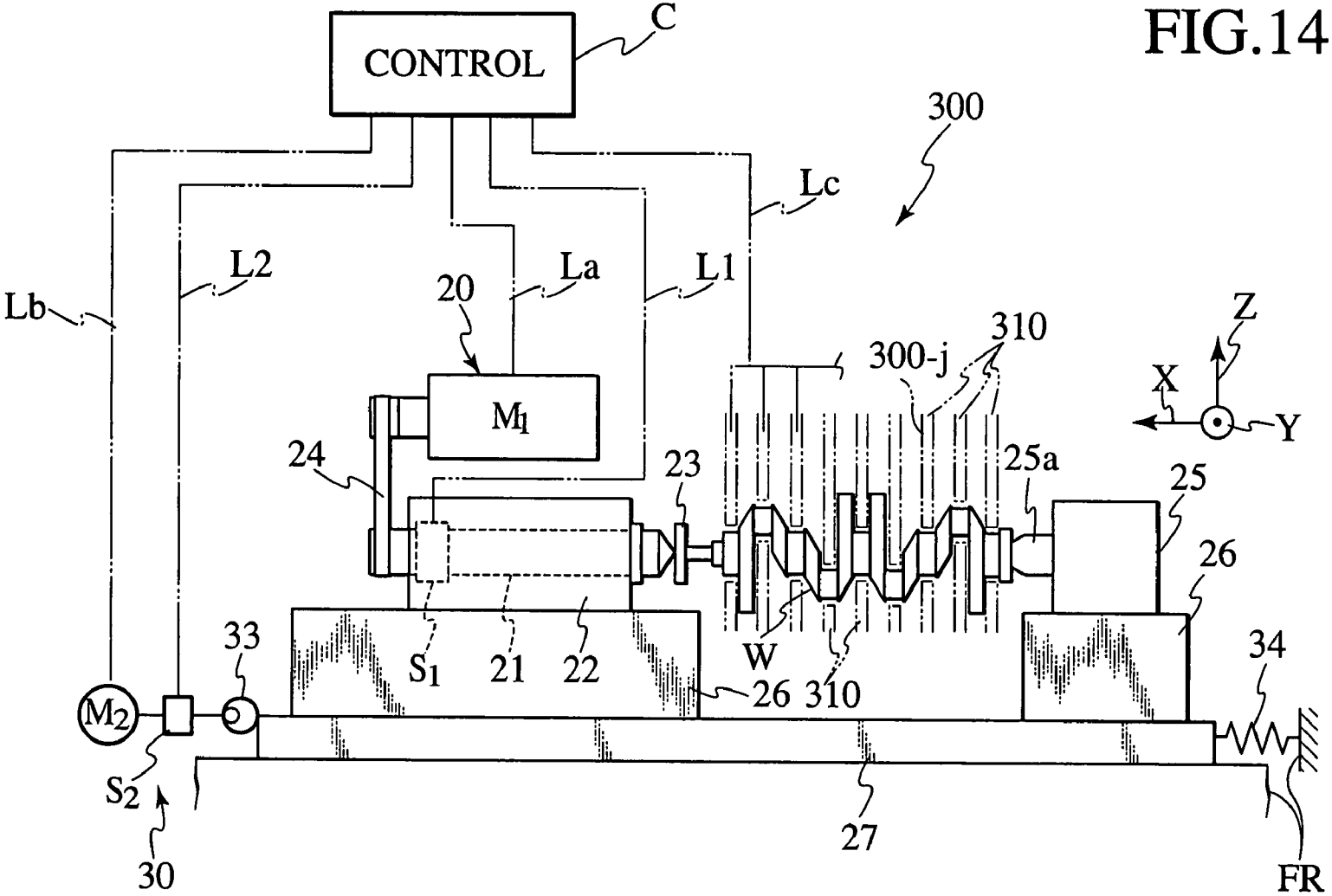
FIG. 14 is a left side elevation of a lapping apparatus according to a third embodiment of the invention.
Figure 15:
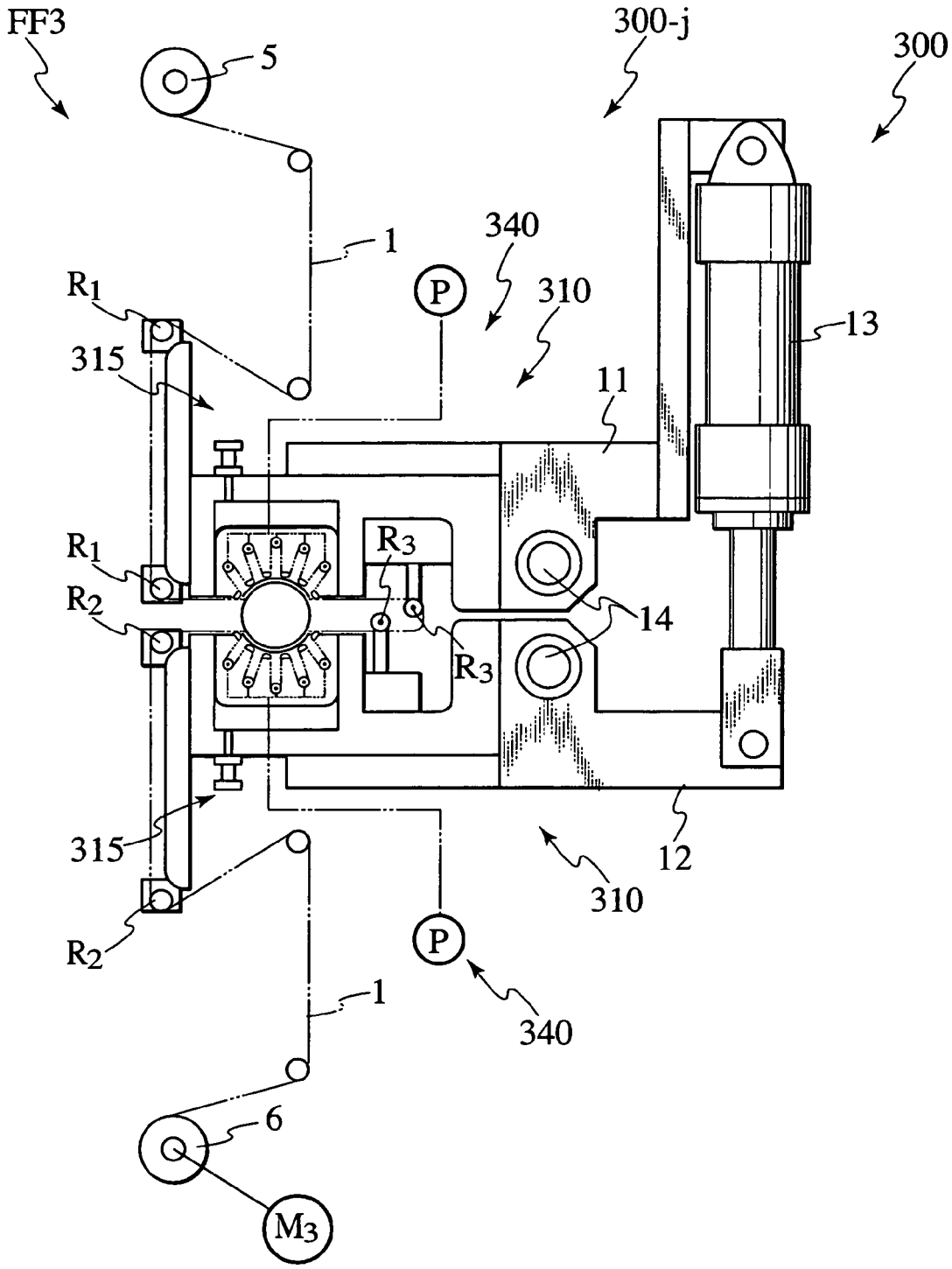
FIG. 15 is a rear view of a close state of a lap of the apparatus of FIG. 14.
Figure 16:
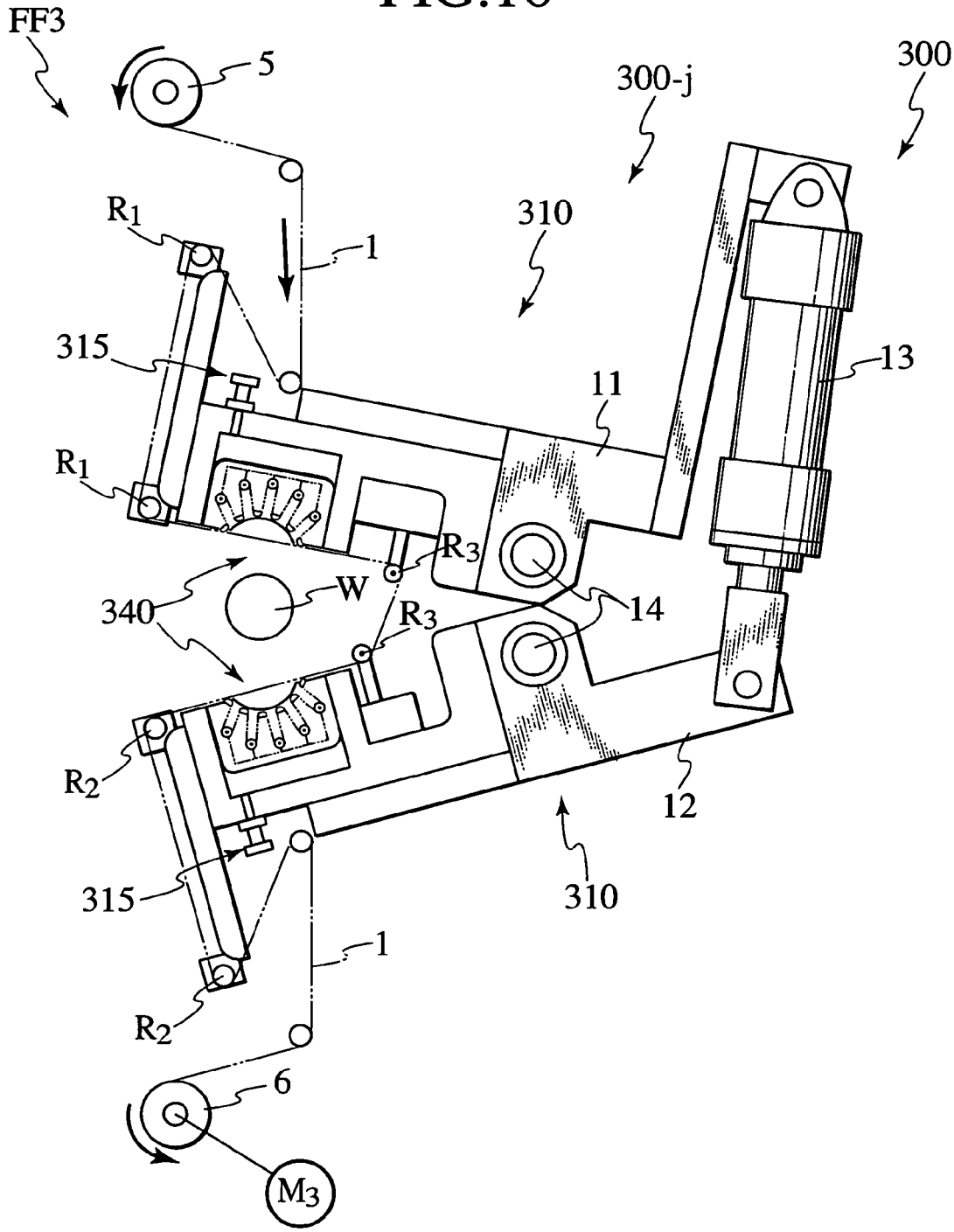
FIG. 16 is a rear view of an open state of the lap of FIG. 15.
Figure 17:
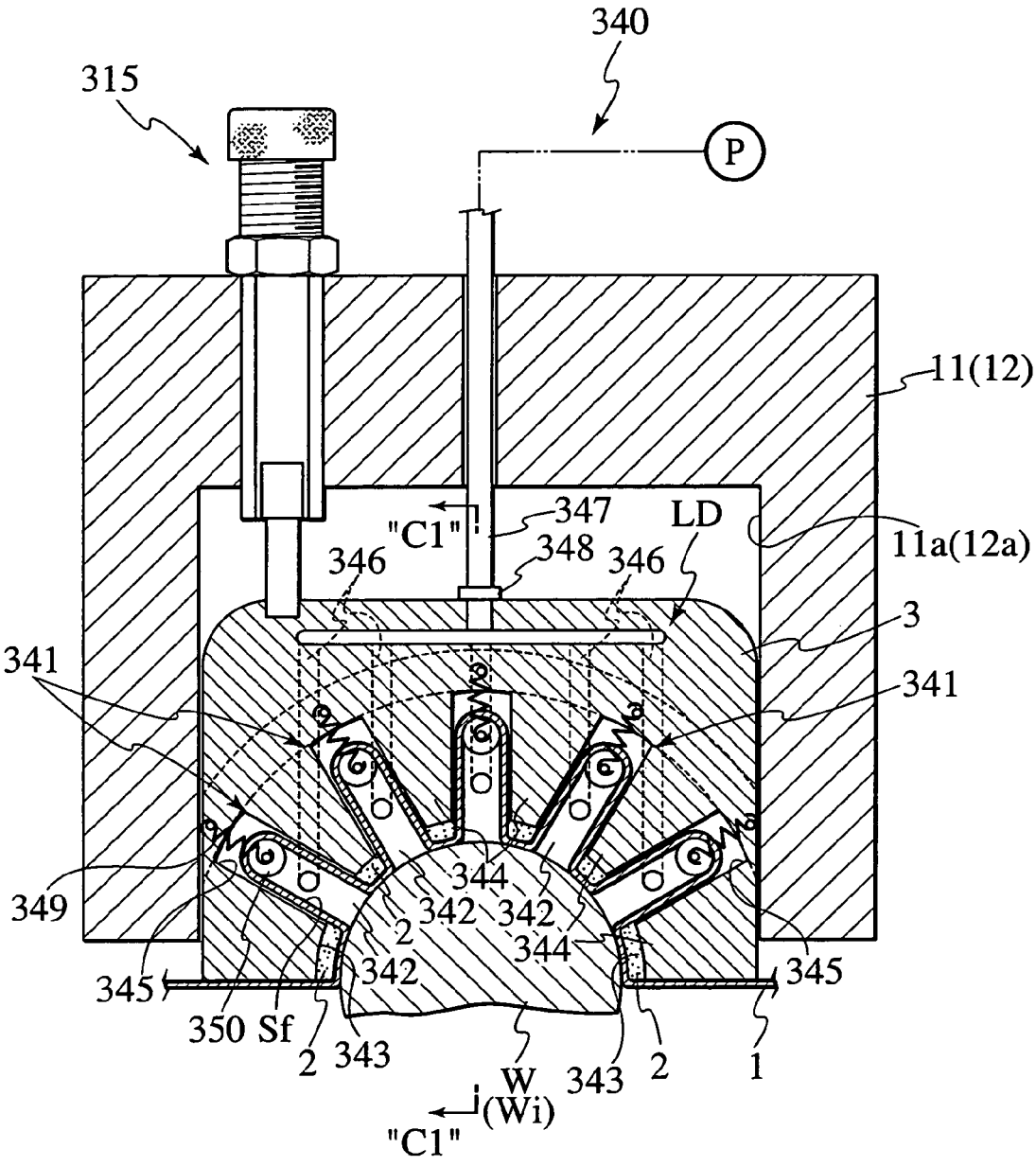
FIG. 17 is a sectional view of an upper or lower lap of the lap of FIG. 15.
Figure 18:
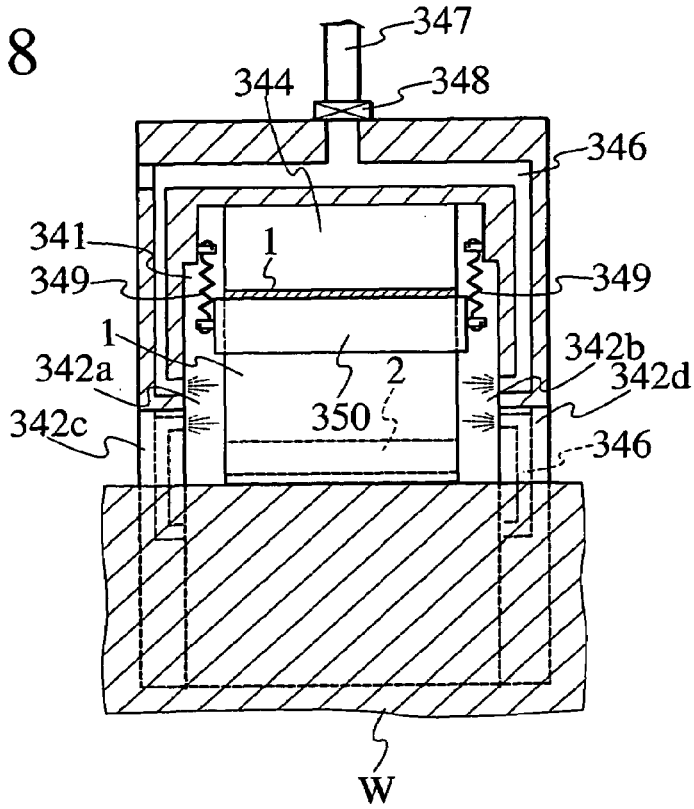
FIG. 18 is a section along line "C1"-"C1" of FIG. 17.

Description is now made of a third embodiment of the invention, with reference to FIG. 14 to FIG. 18. FIG. 14 shows a lapping apparatus 300 according to the third embodiment, FIG. 15, a close state of a lap 300-j of the apparatus 300, and FIG. 16, an open state of the lap 300-j. FIG. 17 is a section of a push arm 11 or 12 of an upper or lower lap 310 of the lap 300-j, and FIG. 18, a section along line "C1"-"C1" of FIG. 17.

This embodiment is different from the previous embodiments in that the lap 300-j has upper and lower laps 310 each respectively provided with a shoe pushing mechanism 340 including a pushing force regulator 315 and an internal lubricant distributing supply system LD connected to an external lubricant pump P, and a film feed system FF3 has a cooperative configuration thereto. Detection signals from rotary encoders S1, S2 of drive motors M1, M2 are input to a controller C, via signal lines L1, L2, as explained in the first embodiment 100.

Upper push arm 11 (or lower push arm 12) is formed with an upper (or lower) left rectangular recess 11*a* (or 12*a*) for accommodating a shoe case 3. This case 3 is vertically slidable along the recess 11*a* (or 12*a*) for adjustment of pushing force by regulator 315, which is a combination of a shoe case pushing spring and a spring force adjust screw.

The shoe case 3 is formed with a machine-longitudinally extending semicircular recess, which has a number of machine-longitudinally extending radial slots 345 cut therein, defining trapezoidal projections 344 therebetween as shoe supports. These projections 344 have their arcuate tops 343 as remaining parts of the semi-circular recess, where respective shoes of shoe set 2 are attached, and a lapping film 1 is guided in a waving manner along the projection tops 343 and left and right walls of the radial slots 345 so that radial spaces 342 are defined between lengths of film 1 on the left and right walls.

As the projection tops 343 push the shoes, the shoe set 2 is conformally pressed on corresponding surface regions of work W (or work part Wi), and remaining surface regions of work W extend at open ends of the radial spaces 342. For drawing the film 1 into depth of each slot 345, there is provided at the slot bottom a film detour provider 341 constituted with a pair of springs 349 secured to left and right walls of the slot 345, and a tension roller 350 rotatably suspended by springs 349 and normally biased radially outward by resiliency of the springs 349, causing the film 1 to be tensed in that direction. The rotatably suspended roller 350 has a reduced tendency to be abraded by film 1, giving an extended service life to the detour provider 341, allowing a smooth feed of film 1 and a simplified structure of film feed system FF3.

For installation, a sufficient length of film 1 is inserted into slot 345 to have a radial detour once made therein, turning over the tension roller 350 at a proximal end of trapezoidal projection 344, before a return to pass between the work W and an associated shoe. The wavy layout of film 1 using slots 345 ensures each radial space 342 to be open at both front and rear ends 342*a*, 342*b*, and to be defined by a film detour around tension roller 350, opposing lengths of film 1 at both left and right sides, and an exposed region of a circumference of work W to be lapped. The circumference of work W alternately has a region exposed without coverage by film 1, and a region covered with film 1.

The internal lubricant supply system LD is formed as a network of lubricant paths 346 in the shoe case 3, and connected to the external lubricant pump P via a coupling 348 and a connection tube 347, which tube 347 is made elastic and expansive to avoid imposing undue dynamic loads on shoe set 2 or shoe case 3.

Each radial space 342 communicates at both front and rear ends 342*a*, 342*b* with lubricant paths 346, allowing lubricant to inflow therefrom, and guides the lubricant along the face Sf of film 1, for ensured conduction over a work surface region to be lapped, as well as between film 1 and a lapping surface region of work W, causing the lubricant to run along a work surface in direct contact, or to a point of work W to be machined, with a resultant spread of contact area between lubricant and work W.

It is noted that pumped lubricant is delivered from lubricant paths 346 into radial space 342, in the machine-longitunal direction, directly flushing the film face Sf exposed inside the space 342, thus washing ground dust from the film face Sf.

It also is noted that the wavy detoured film 1 alternately has a pressed region between a shoe and oscillating work W, where the work W is frictionally lapped with dissipation of heat, and a detour region defining the radial space 342, where the work W is exposed. As flux of lubricant in each radial space 342 is guided by exposed faces Sf (of the detour region of film 1) toward the exposed work surface, most flows out through externally communicating front and rear central spaces 342*c*, 342*d*, together with ground dust, depriving work of heat, and the rest is supplied between the pressed region of film 1 and the work W, passing a gap therebetween, depriving heat therefrom, to outflow into the next radial space 342. Lubricant is thus lead over work surfaces to be lapped and between the work surface and film or between the film and shoe, effecting their cooling and ground dust removal, while such intrusion of lubricant might otherwise be difficult.

The foregoing effects develop at respective locations of film detour providers 341, allowing facilitated supply of lubricant to plural points of work to be machined, with a commensurate increase in spread of contact area between lubricant and work W, enabling smoother removal of ground dust, and enhanced cooling of film 1 and work W.

Modification of Third Embodiment

Figure 19:
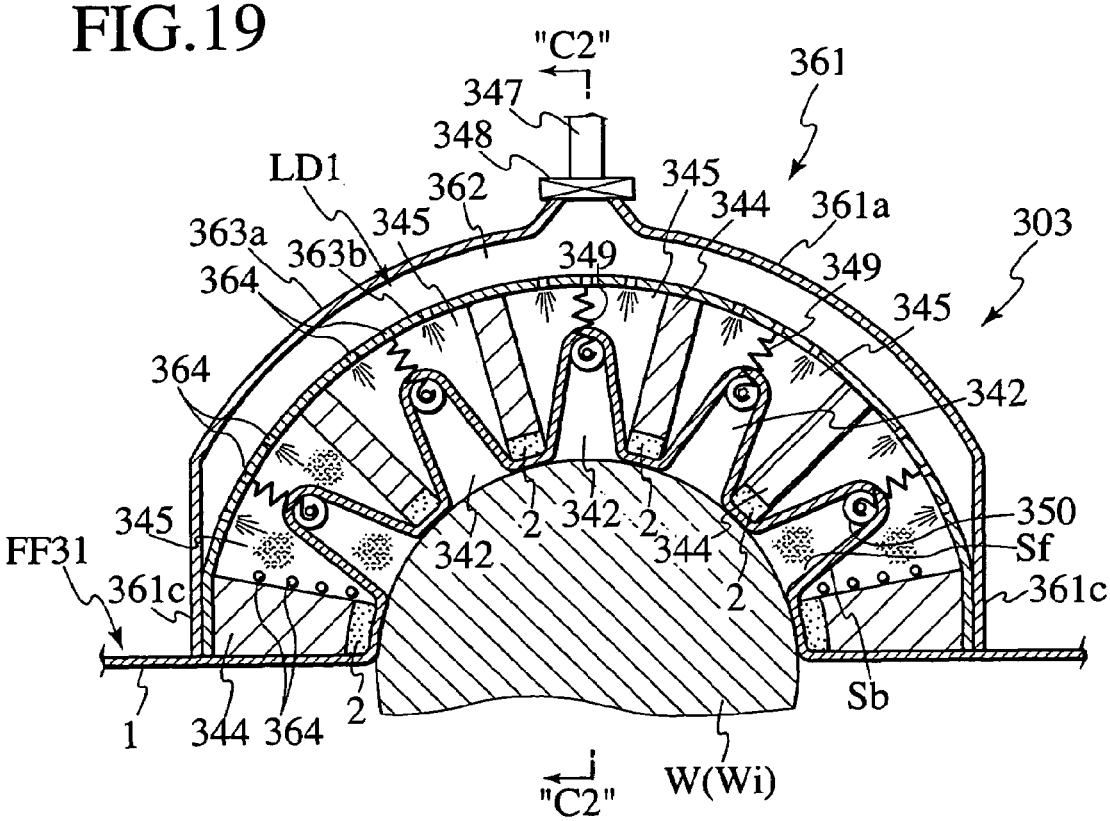
FIG. 19 is a sectional view of a shoe case of an upper lap of a lap of a lapping apparatus according to a modification of the third embodiment.
Figure 20:
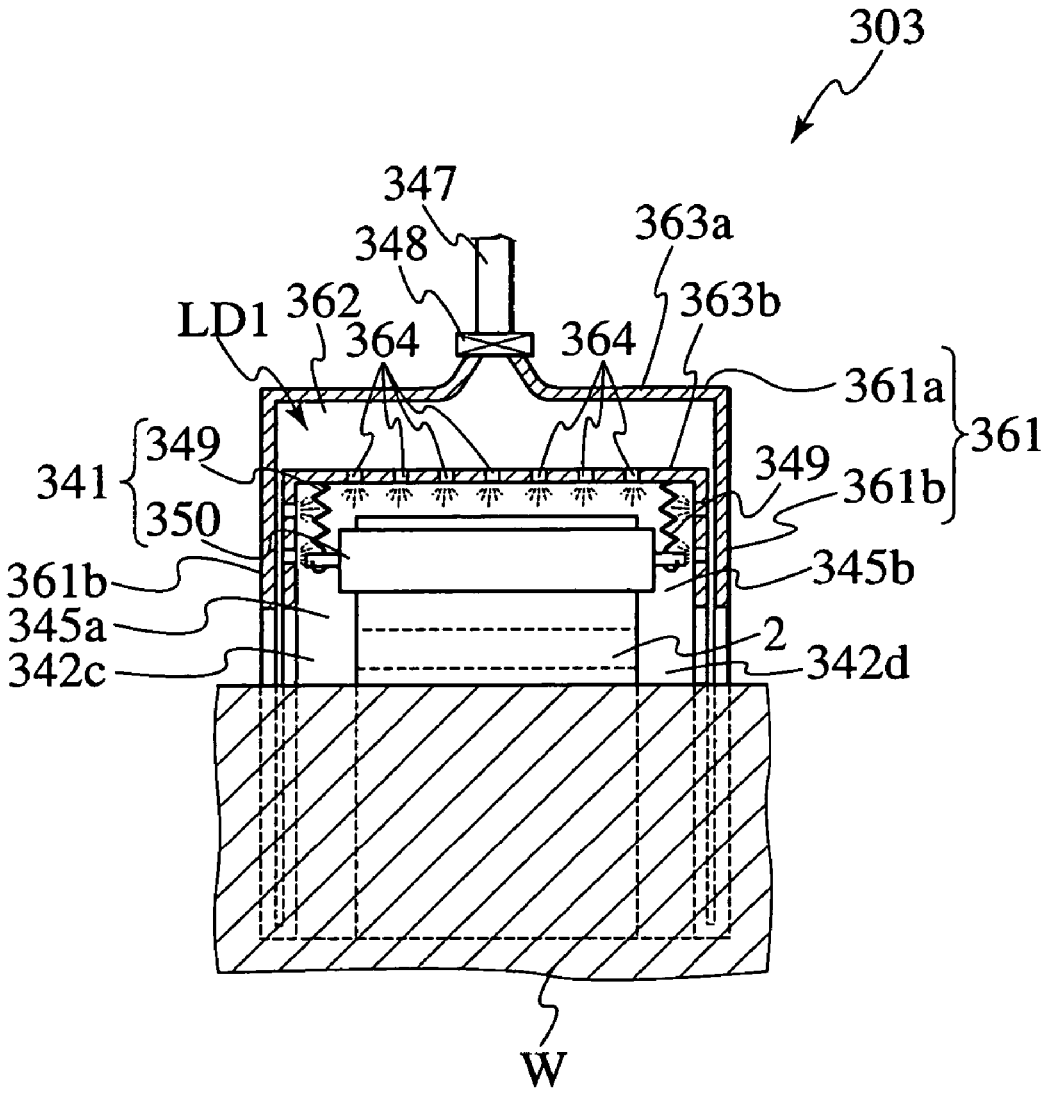
FIG. 20 is a section along line "C2"-"C2" of FIG. 19.

FIG. 19 shows a shoe case 303 of an upper lap of an arbitrary lap of a lapping apparatus according to a modification of the third embodiment, and FIG. 20 is a section along line "C2"-"C2" of FIG. 19.

This modification is different from the third embodiment in that supplied lubricant from an external lubricant pump P (FIG. 17) is distributed and atomized or discharged to be showered over a back side Sb (refer to FIG. 26) of regions of a lapping film 1 in service, and the shoe case 303 as well as an internal lubricant distributing supply system LD1 has a modified configuration, and a film feed system FF31 has a cooperative configuration thereto.

The hollow shoe case 303 is configured with: a machine-longitudinally extending hollow shoe case member 361 including a semi-cylindrical top portion 361*a*, front and rear vertical portions 361*b*, and left and right side portions 361*c*; and a number of machine-longitudinally extending planer support members 344 radially arranged at angularly equi-intervals inside the shoe case member 361.

The shoe case member 361 has a jacketed structure configured with outer and inner walls 363*a*, 363*b* cooperatively defining a semi-cylindrical or barrel vault-shaped hollow 362 for distributing supplied lubricant over the inner wall 363*b*. The inner wall 363*b* is formed with a multiplicity of evenly distributed through holes 364 for atomizing or discharging distributed lubricant to shower into a number of machine-longitudinally extending trapezoidal slots 345 defined between the planer support members 344. The support members 344 have a shoe set 2 attached to their radially inner proximal ends, and are fixed at their radially outer ends to the inner wall 363*b*.

The film feed system FF31 has in each trapezoidal slot 345 a film detour provider 349 configured with a pair of front and rear springs 349 secured to the inner wall 363*b*, and a machine-longitudinally extending tension roller 350 rotatably suspended by the springs 349 and normally biased radially outward by resiliency of the springs 349. A lapping film 1 is passed between the shoe case 303 and a work W (or work part Wi), and wavy detoured to alternately have a pressed region between a shoe and a surface region of work W being lapped, and a length of detour stretched over the tension roller 350, defining a radial space 342, where a surface region of work W to be lapped is exposed.

The lubricant supply system LD1 is constituted with the hollow 362, holes 364, outer radial spaces 345 as defined by the back Sf of detoured film 1, with connected front and rear ends 345*a*, 345*b* inclusive, inner radial spaces 342 defined by the face Sf of detoured film 1, and externally communicating front and rear central spaces 342*c*, 342*d*.

Water shower from top portion 361*a* flushes each outer radial space 345, flowing some into inner radial spaces 342, and most out of central spaces 342*c*, 342*d*, depriving frictional heat from regions of film 1 and work W to be cooled. Water shower from front and rear portions 361*b* to each inner radial space 342 is guided by film 1 and exhibits like effects to the third embodiment.

Water is showered to entire space region irrespective of locations of film detour providers 341, achieving overall film cooling, with ensured supply of lubricant to whole points of work being machined or to be machined, and efficient removal of ground dust and fallen abrasive particles, allowing the work to be finished with enhanced uniform surface roughness, and improved machining quality.

Fourth Embodiment

Figure 21:
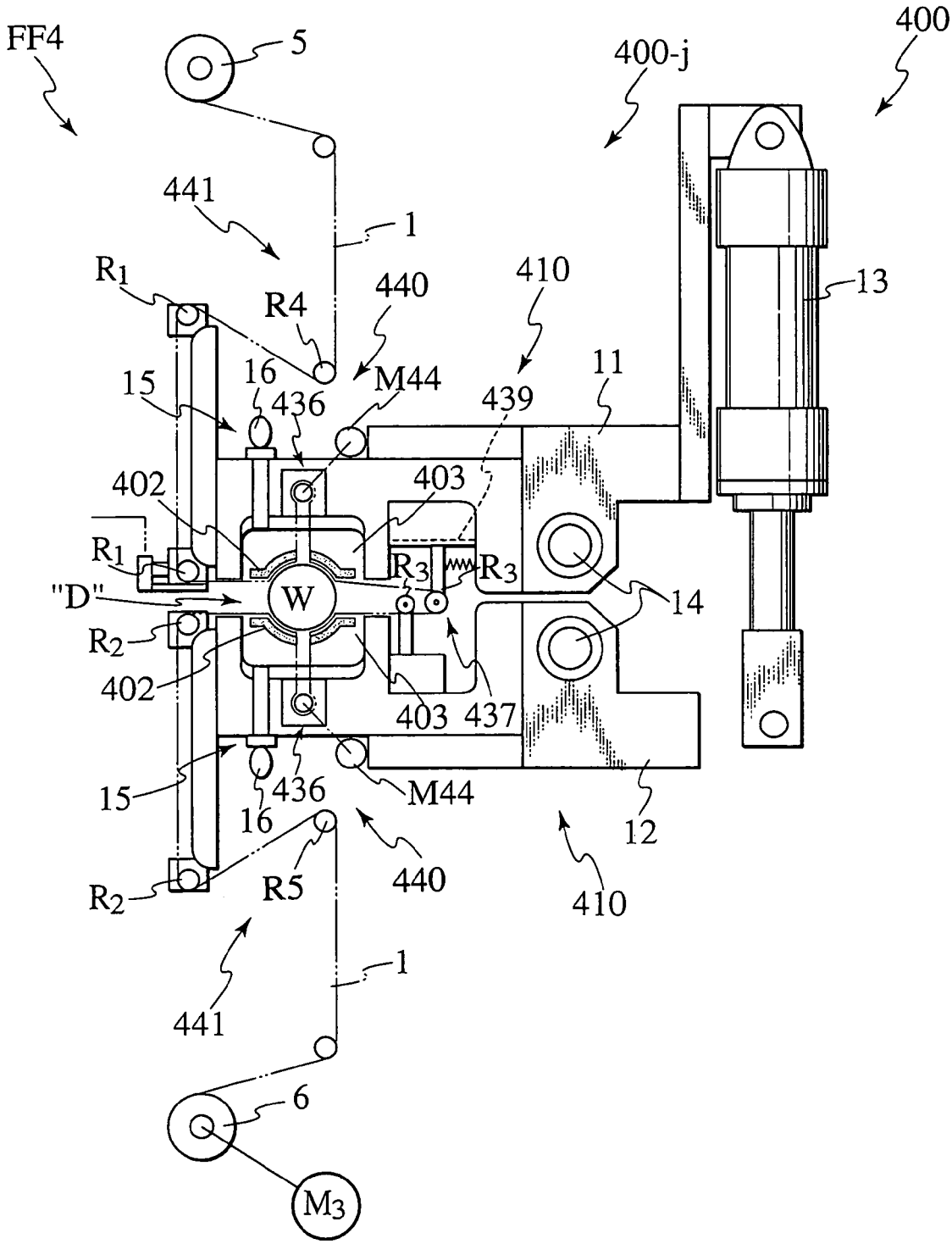
FIG. 21 is a rear view of a close state of a lap of a lapping apparatus according a fourth embodiment of the invention.
Figure 22:
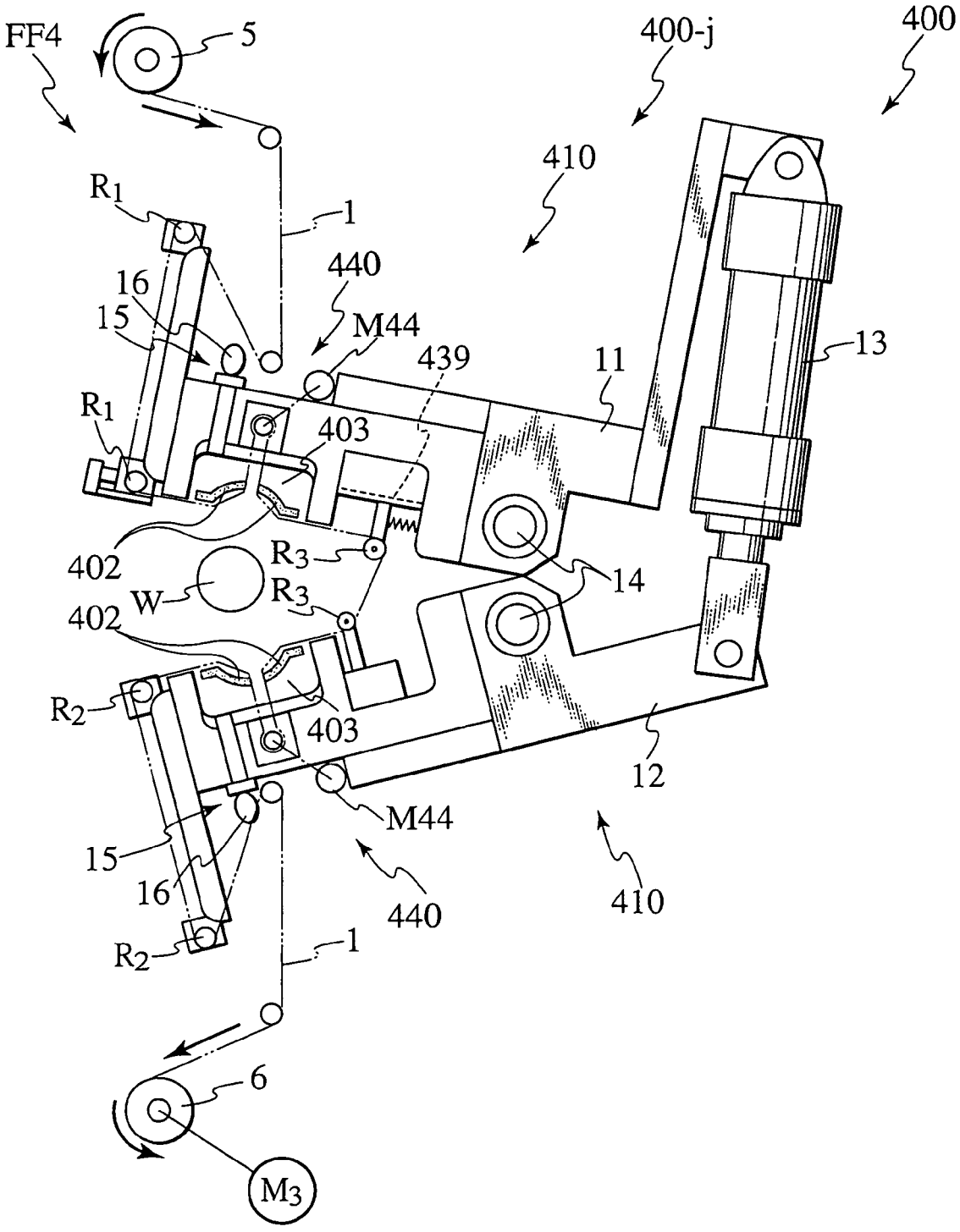
FIG. 22 is a rear view of an open state of the lap of FIG. 21.
Figure 23:
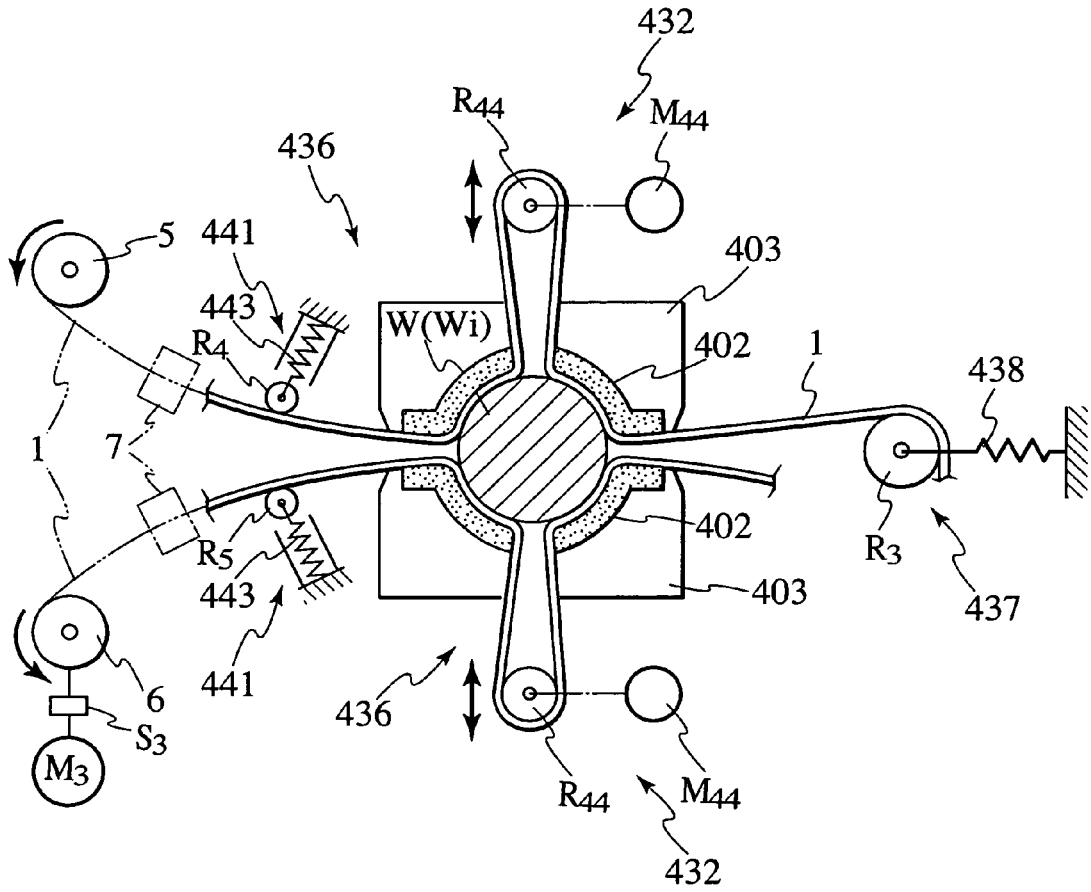
FIG. 23 is a detail "D" of FIG. 21.

Description is now made of a fourth embodiment of the invention, with reference to FIG. 21 to FIG. 23. FIG. 21 shows a close state of a lap 400-j of a lapping apparatus 400 according the fourth embodiment, and FIG. 22, an open state of the lap 400-j. FIG. 23 is a detail "D" of FIG. 21.

This embodiment is different from the previous embodiments in that the apparatus 400 includes a "film oscillator" as a combination of upper and lower machine-transversely reciprocal or oscillatory mechanisms 432 (FIG. 23), besides a "work oscillator" as a machine-longitudinally reciprocal or oscillatory mechanism 30 (FIG. 1). Each oscillatory mechanism 432 is responsible for an oscillation of a film 1 to be fast enough to be free from influences of work rotation speed. For the film oscillation to be effective in a feed direction of the film 1, the oscillatory mechanism 432 employs an oscillation-oriented vertical film drawer 436 and a tensioning-oriented horizontal film drawer 437. This drawer 437 is responsible for a film feed to that drawer 432 in synchronism with the oscillation, and is communized between the upper and lower oscillatory mechanisms 432.

The lap 400-j (FIGS. 21-22), includes: a film feed system FF4 configured for an NC-controlled feed of the film 1; and a pair of upper and lower laps 410 each respectively provided with a shoe pusher 440 having a shoe case 403 for pushing a shoe set 402 against a surface region of a work W (or work part Wi) to be lapped, with the film 1 pressed therebetween.

The vertical film drawer 436 includes a radial tension roller R44 adapted for the film 1 to be detoured therearound through shoes of either shoe set 402, and a motor-driven oscillator M44 configured to oscillate the roller R44 in a radial direction. This oscillation may be otherwise effected, e.g. by a fluid-pressure cylinder.

The horizontal film drawer 437 includes a radial tension roller R3 adapted for the film 1 to be detoured therearound through shoe sets 402, and a resilient member 438, e.g. spring, adapted to normally bias the roller R3 in a radial outer direction, allowing supply of necessary length of film 1 for film oscillation at the drawer 436. The roller R3 supported by a rod is guided by a rod guide 439 (FIGS. 21-22) to be set in pulled position when the lap 40j is closed.

The film feed system FF4 includes upper and lower tension controllers 441 using upper and lower tension rollers R4, RS, respectively, which are normally biased in their film tensioning directions by upper and lower resilient members 443 (FIG. 23), such as a spring secured to a machine frame FR (FIG. 1). The controller 441 provides a tension allowance between a locking device and either shoe set 402, to facilitate the film supply and smooth film oscillation in the feed direction. At the supply side or take-up side of the film feeder FF4, the tension roller R4 or R5 has its acting points on the film 1 located between an acting point of film locker 7 and the shoe set 2.

For a fine oscillation, the shoe set 402 may be multidivided to repeat an alternate arrangement of oscillation-oriented film drawer and tensioning-oriented film drawer.

The work W may have an offset journal part Wi eccentric in rotation, which can be followed for lapping by cooperation of swingable arms 11, 12.

Along with radially outward movement of both or either roller R44, the spring 438 of film drawer 437 expands to supply a necessary length of film 1, allowing smooth movement of roller(s) R44. Film 1 is thin but strong enough to endure the pulling.

In cooperation of film oscillator and work oscillator, work W undergoes a jigzag contact with film 1, to be lapped with an increased number abrasive particles, allowing for a shorter efficient machining. Zigzag work makes ground dust finer and more removable, with a reduced blocking tendency. For a 60-mm diameter journal part of a crankshaft, the lapping can be proper with an oscillation amplitude of roller R44 within a range of 0.5 to 2.0 mm, while about 1 mm is preferable. For oscillation frequency of roller R44, the lapping can be proper within 10 Hz to several KHz, while 80 Hz or more is preferable.

Fifth Embodiment

Figure 24:
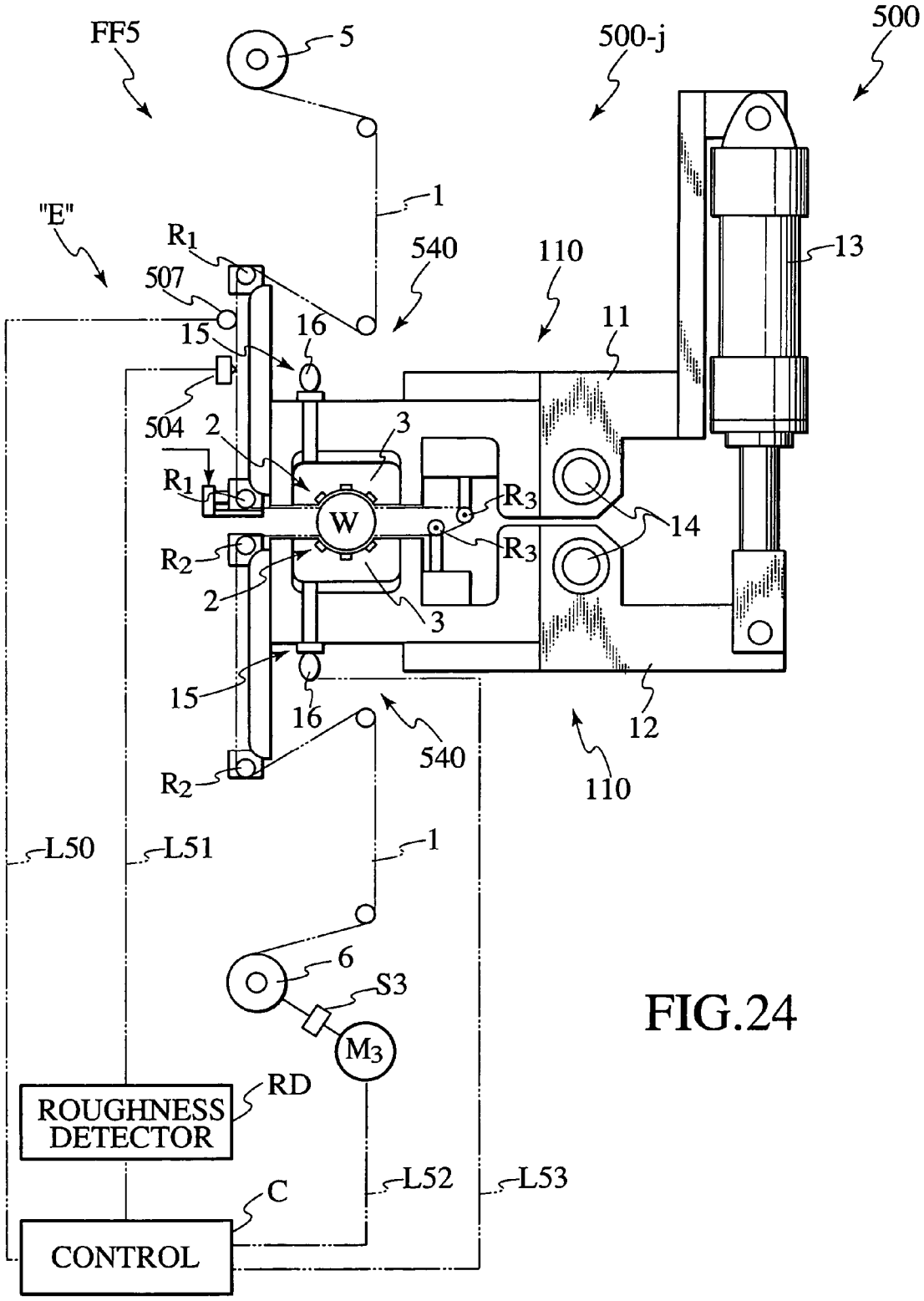
FIG. 24 is a rear view of a close state of a lap of a lapping apparatus according to a fifth embodiment of the invention.
Figure 25:
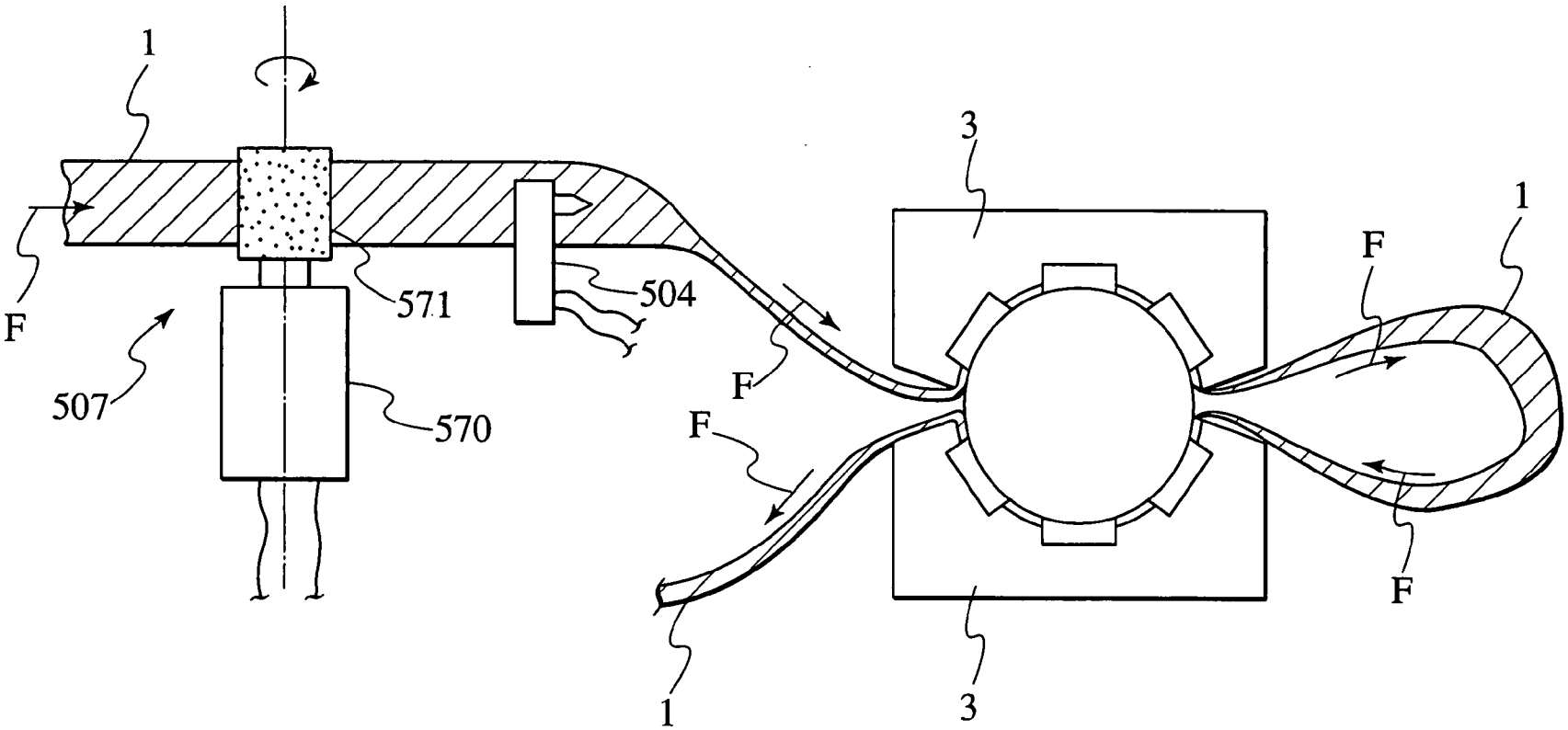
FIG. 25 is a detail "E" of the lap of FIG. 24.

Description is now made of a fifth embodiment of the invention, with reference to FIG. 24 to FIG. 26. FIG. 24 shows a close state of a lap 500-j of a lapping apparatus 500 according to the fifth embodiment. FIG. 25 is a detail "E" of FIG. 24, and FIG. 26, a section a film 1.

This embodiment is different from the previous embodiments in that the lap 500-j has a control system including a roughness detector RD having a camera 504 connected thereto via a data line L51, and a controller C for processing a picture data as detection data from the detector RD.

The detector RD is adapted to detect an abrasive condition in terms of a surface roughness of a face Sf (FIG. 26) of an unused region of the film 1 between rollers R1 of a film feed system FF5.

The controller C is adapted to control: a drive motor M3 of a take-up reel 6, via a command line L52; a pushing force regulator 15 of each shoe pusher 540, via a command line L53; and a truer 507 for truing projection height h (above adhesive layer 1*a* on substrate 1*b*, FIG. 26) of abrasive particles AP on the face Sf of film 1 between rollers R1, upstream the camera 504, via a command line L50.

The roughness detector RD may be an ultra depth configuration measurement microscope (VK-8500, Keyence), non-contact three-dimensional surface configuration roughness measurer (New View 5000: Zaigo Co., Ltd.), or any commercial available roughness detector.

The truer 507 (FIG. 25) is configured with a truer body 570 controlled from the controller C, and a cylindrical truer tool 571 driven to rotate by the truer body 570. The tool 571 has abrasive diamond particles attached thererto. The tool 571 is brought into contact with the face Sf of film 1 being fed F As the tool 571 is driven to rotate, abrasive particles AP (FIG. 26) on the face Sf are ground to a height, before detection by the camera 504.

The detector RD analyze picture data from the camera 504, and calculates projection height of abrasive particles AP, which is input to the controller C, where it is processed for decision on blocking condition of film 1 and faculty of abrasion. Data on decision results are stored in the controller C. As the film 1 enters a service, the controller C depends on stored data to control each pushing force regulator 15 for a desirable lapping, or motor M3 for a film feed control to avoid using a film region low of abrasive faculty. In normal service after truing, shoe pushing force as well as film feed is constant.

First Modification of Fifth Embodiment

Figure 27:
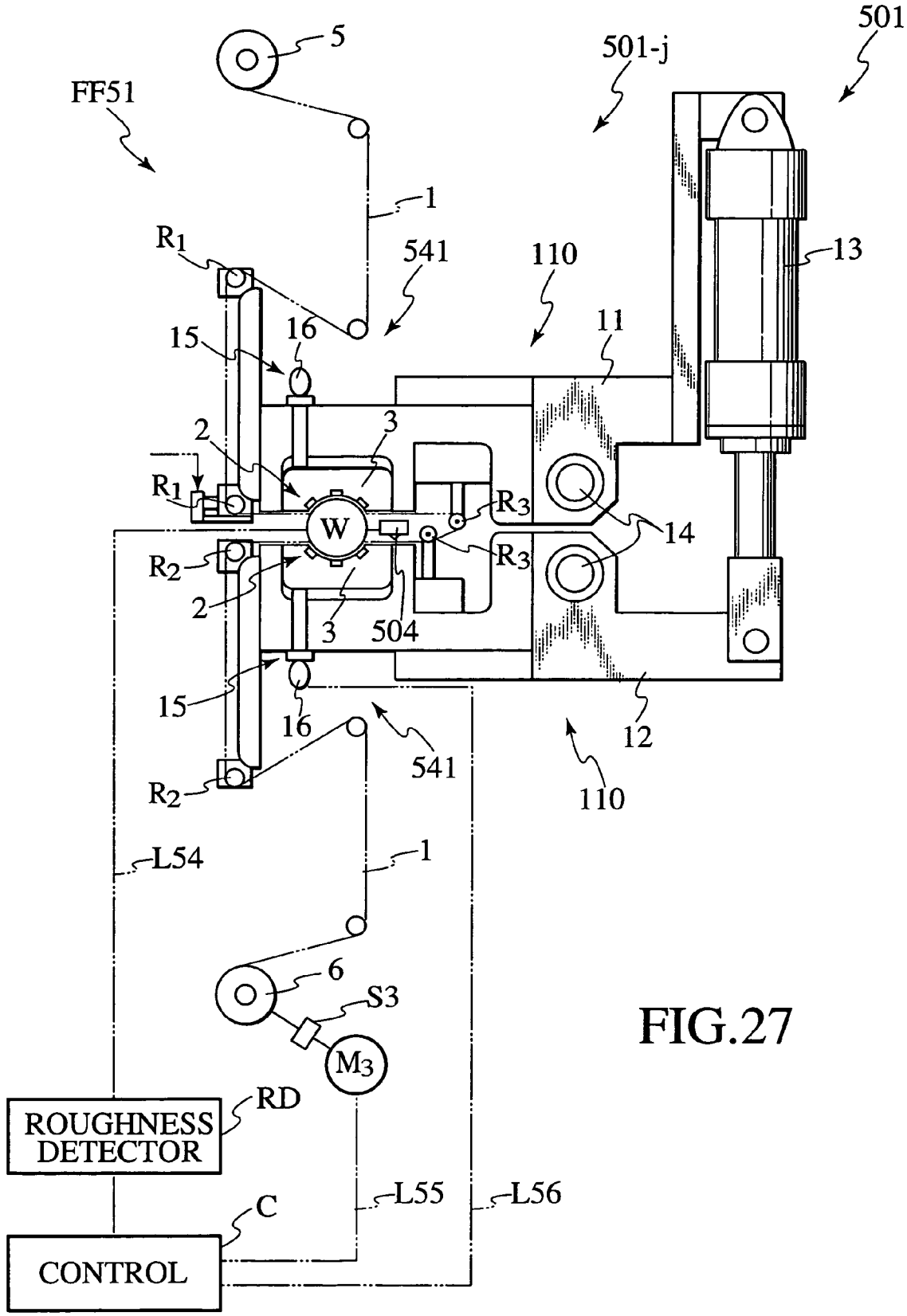
FIG. 27 is a side elevation of a close state of a lap of a lapping apparatus according to a first modification of the fifth embodiment.
Figure 28:
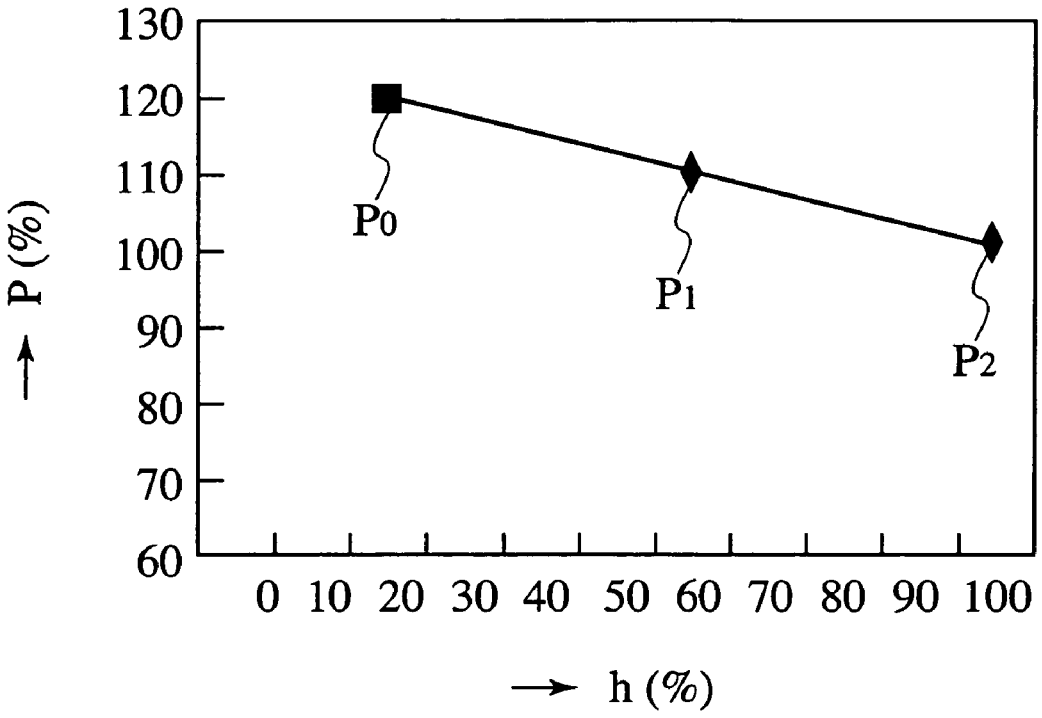
FIG. 28 is a graph of a characteristic curve of the lap of FIG. 27.

FIG. 27 shows a close state of a lap 501-j of a lapping apparatus 501 according to a first modification of the fifth embodiment, and FIG. 28, a P-h characteristic curve of the lap 501-j.

This modification is different from the fifth embodiment in that a camera 504 is arranged to detect a film 1 on the way between shoe sets 2. The camera 504 is connected via a data line 154 to a roughness detector RD, and a controller C connected to the detector RD has a command lines L55 connected to a take-up reel drive motor M3 of a film feed system FF51, and a command line L56 connected to a pushing force regulator 15 of each shoe pusher 541.

The camera 504 takes an image of a state of abrasive particles on lapping film 1, and sends the image to the roughness detector RD. The roughness detector RD calculates a projection height of abrasive particle from the image. The calculation result of the projection height is sent from the roughness detector RD to a controller C. The controller C judges a blocking degree of abrasive particles, and stores a result of the judgment and a position where the blocking is detected, and then, the controller C controls the movement of each configuration of the lapping apparatus.

On the basis of the projection height of the abrasive particle, the controller C controls a motor M3 and a pushing-force regulator 15 to secure a stable lapping.

When lapping the work by the blocking position of the lapping film 1, the lapping becomes inadequate, thereby not obtaining a desired surface roughness. Thus, the controller C judges a blocking degree of abrasive particles whether the projection height is in a state of performing an appropriate lapping. If abrasive particles are clogged to a large degree, the controller C controls the motor M3 to send the lapping film so as not to use the position where the abrasive particles are clogged.

If abrasive particles are dogged to a large degree, the controller C controls the pushing-force regulator 15 to increase a shoe pushing force. Thus, in case of blocking the abrasive particles, a desired surface roughness of the work can be obtained.

The relationship between the projection height h of the abrasive particles and the shoe pushing force P is explained with FIG. 7.

If the projection height h of the abrasive particles is 100%, the desired surface roughness of the work can be obtained when the shoe pushing force P is 100%. However, if the projection height h of the abrasive particles is 60%, the desired surface roughness of the work cannot be obtained when the shoe pushing force P is 100%, that is, the shoe pushing force P needs to be 120%.

The controller C controls a motor M3 and a pushing-force regulator 15 to secure a stable lapping on the basis of the projection height of the abrasive particles. Thus, the lapping apparatus exhibits such an effect that the stable lapping amount of a surface of the work and the desired surface roughness of the work can be obtained.

Second Modification of Fifth Embodiment

Figure 29:
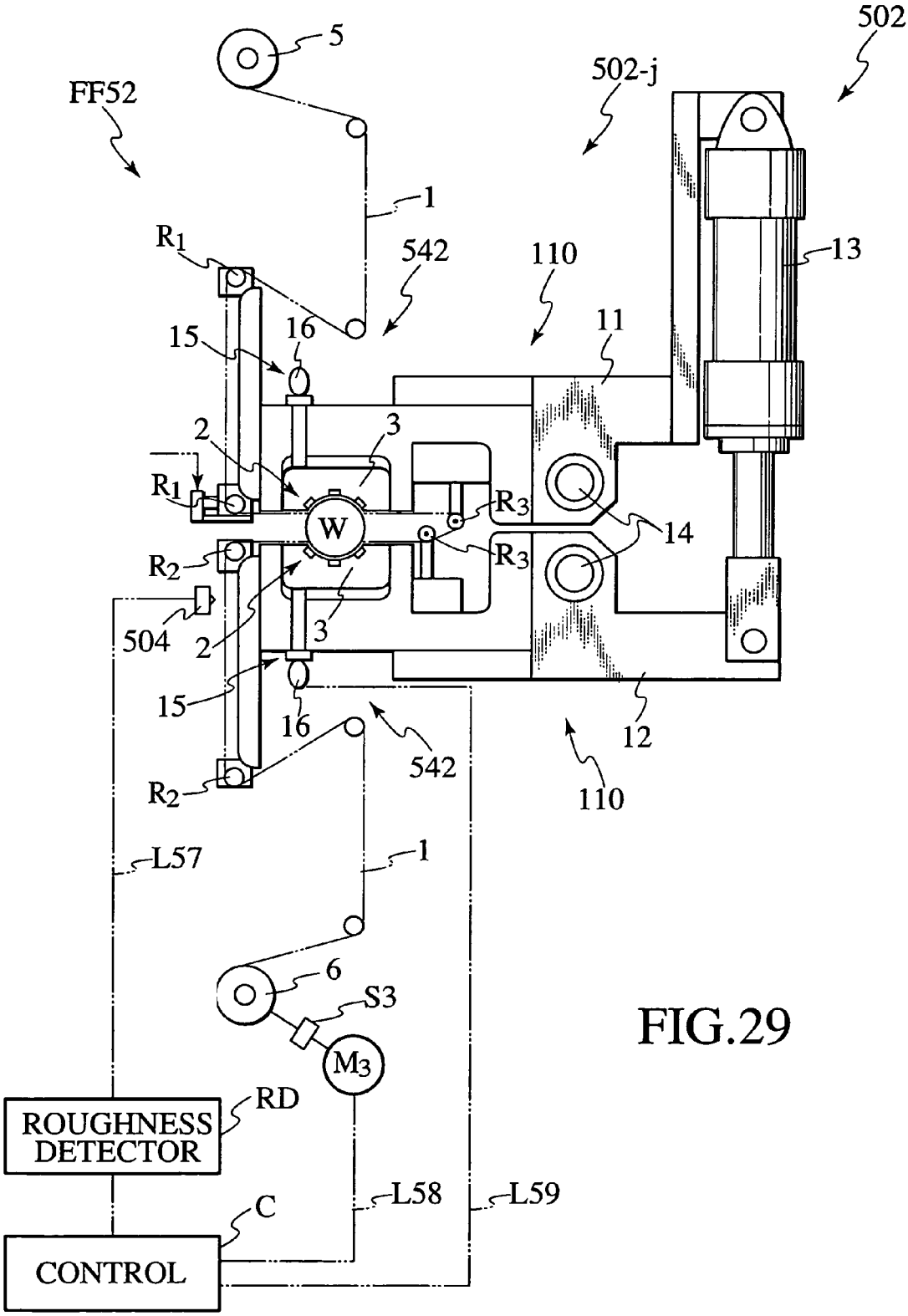
FIG. 29 is a side elevation of a close state of a lapping apparatus according to a second modification of the fifth embodiment.

FIG. 29 shows a close state of a lap 502-j of a lapping apparatus 502 according to a second modification of the fifth embodiment.

This modification is different from the fifth embodiment in that a camera 504 is arranged to detect a film 1 on the way past shoe sets 2. The camera 504 is connected via a data line L57 to a roughness detector RD, and a controller C connected to the detector RD has a command lines L58 connected to a take-up reel drive motor M3 of a film feed system FF52, and a command line L59 connected to a pushing force regulator 15 of each shoe pusher 542.

The camera 504 takes an image of a state of the abrasive particles on the lapping film 1, and sends the image to the roughness detector RD. The roughness detector RD calculates a projection height of the abrasive particle on the basis of the image thereof. The calculation result of the projection height is sent from the roughness detector RD to a controller C. The controller C judges a blocking degree of abrasive particles, and stores a result of the judgment and a position where the blocking is detected, and then, the controller C controls the movement of each configuration of the lapping apparatus.

In the case the abrasive particles are clogged to a large degree, the controller C feeds back the judgment for the future. The controller C judges a blocking degree of the abrasive particles and the blocking position of the lapping film 1 on the basis of the calculated projection height of the abrasive particles, and feeds back the judgment in order to optimize the sending amount of the lapping film 1 and the shoe pushing force to the work. The content being fed back by the controller C is stored in a storage unit, for future use.

Sixth Embodiment

Figure 30:
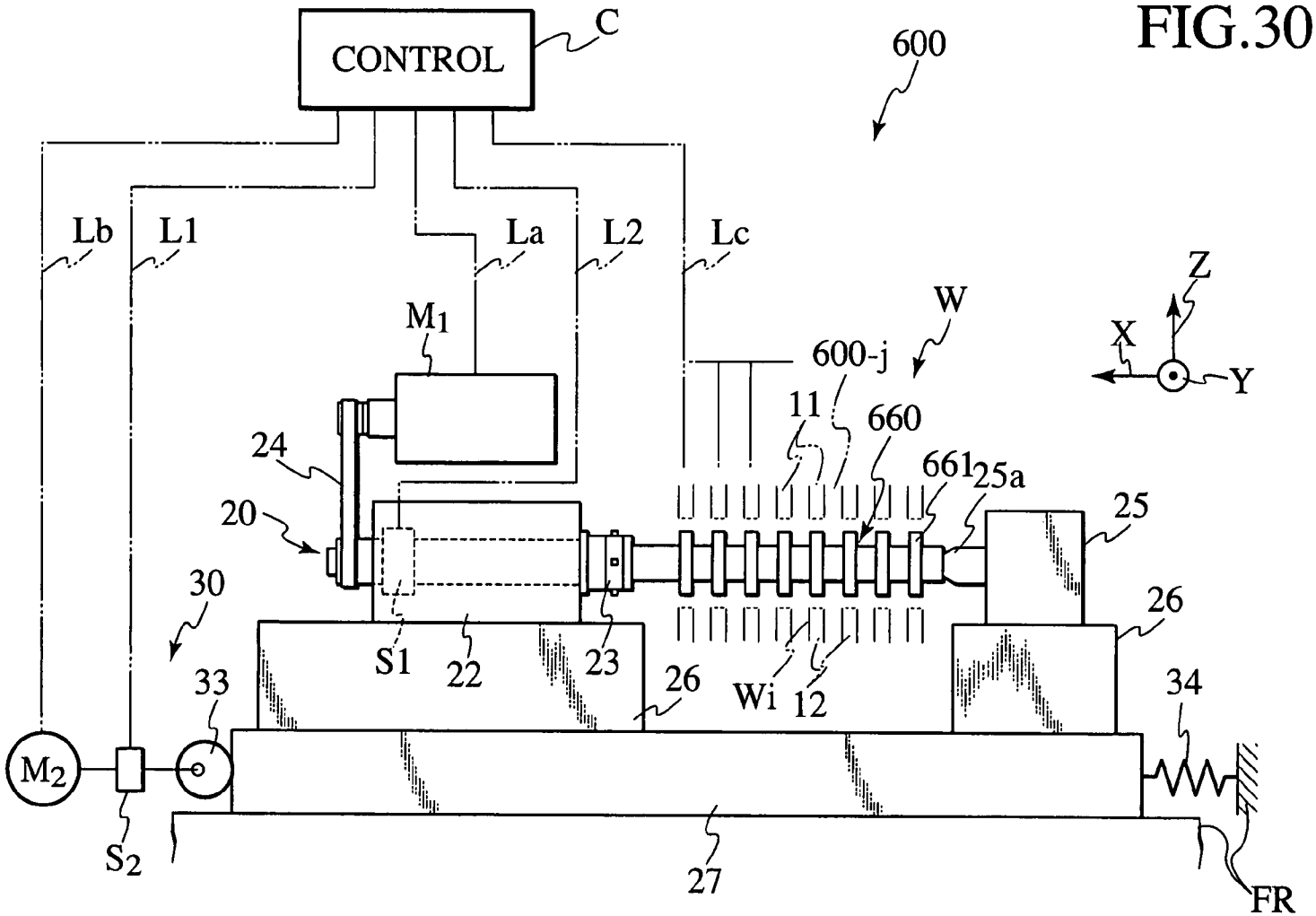
FIG. 30 is a left side elevation of a lapping apparatus according to a sixth embodiment of the invention.
Figure 31:
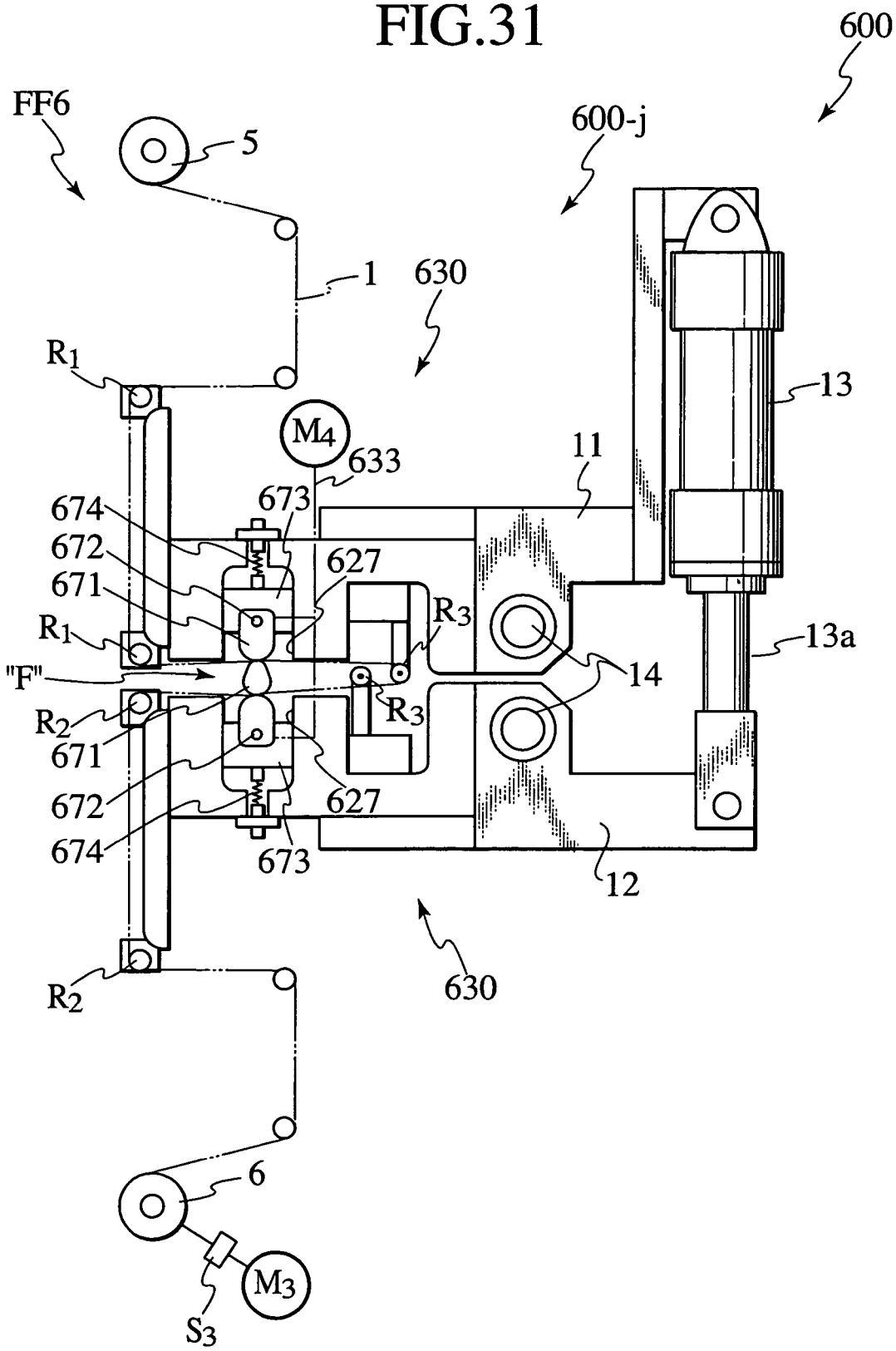
FIG. 31 is a rear view of a close state of a lap of the apparatus of FIG. 30.
Figure 32:
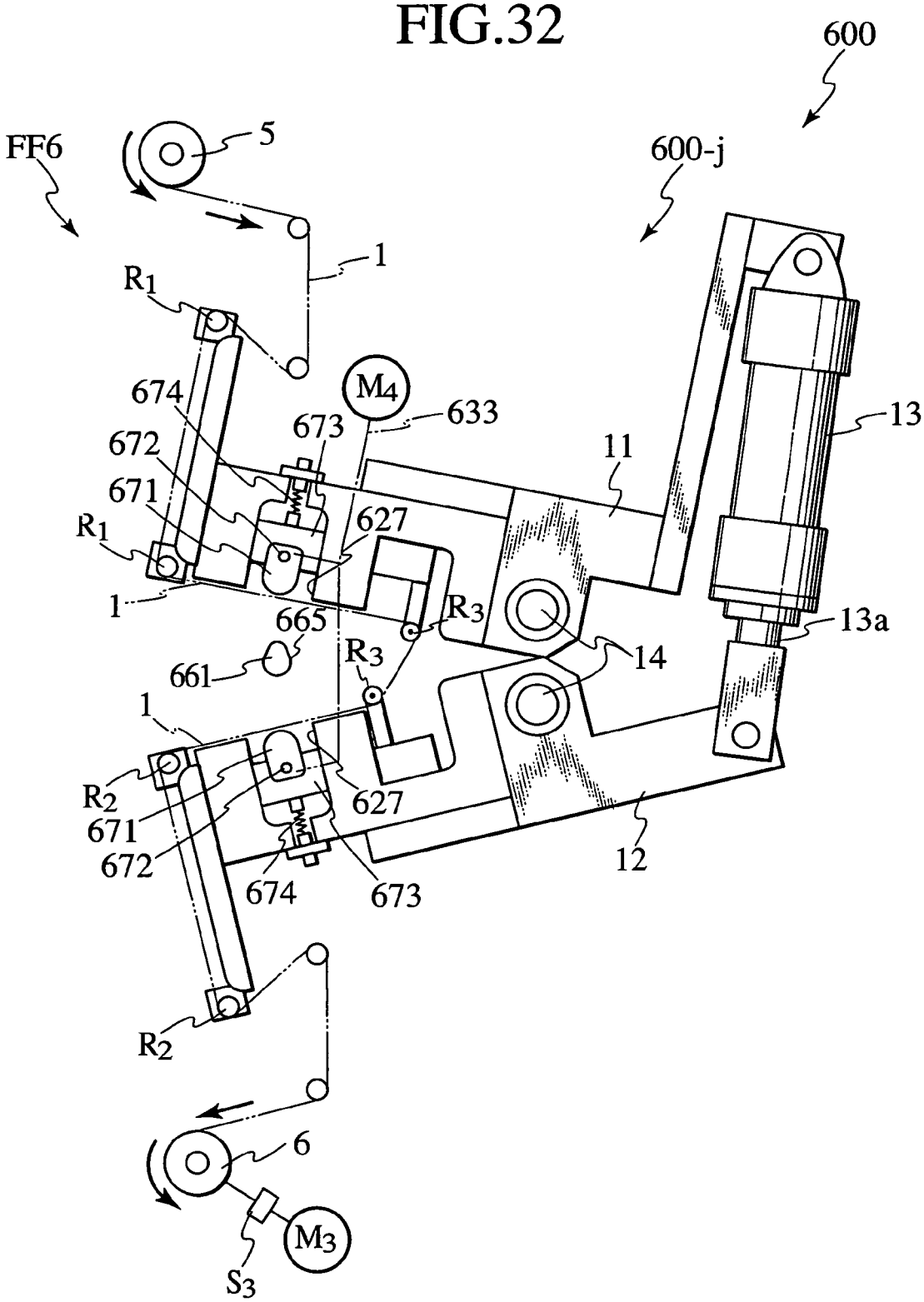
FIG. 32 is a rear view of an open state of the lap of FIG. 31.
Figure 33:
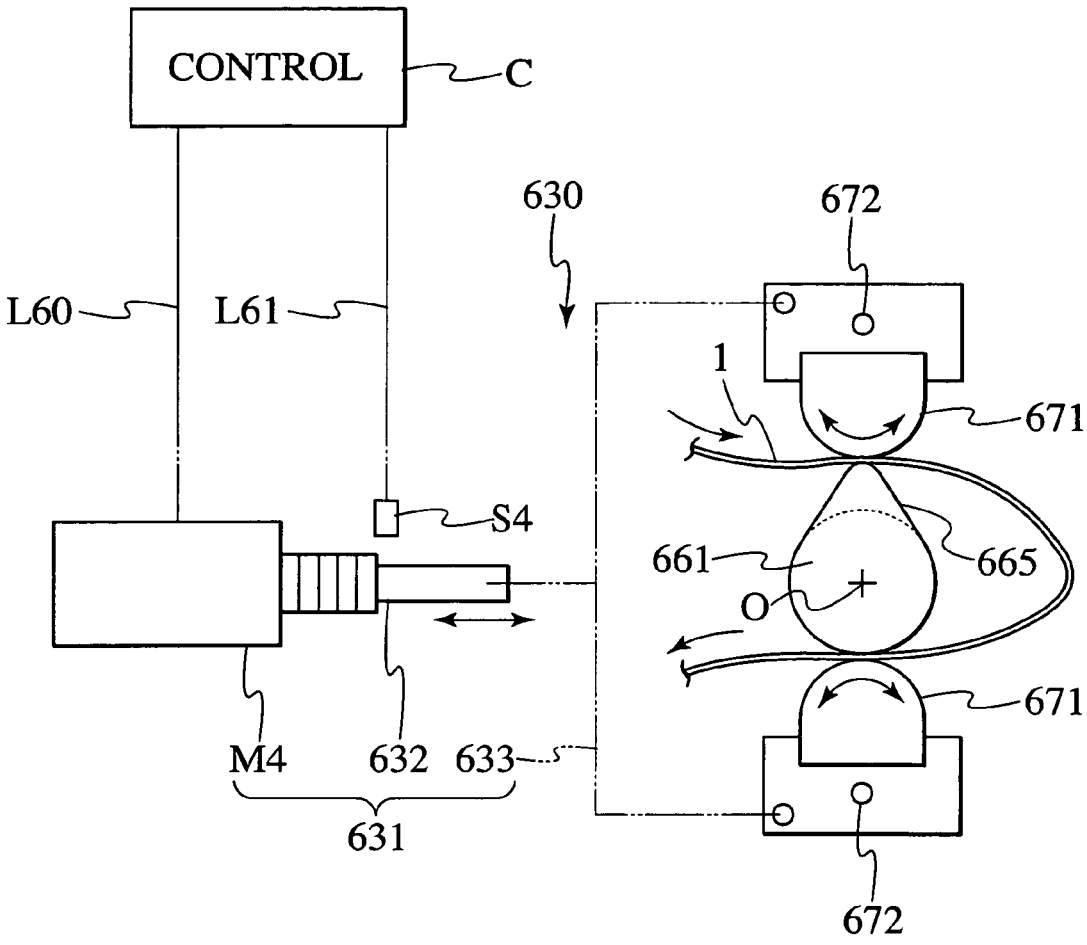
FIG. 33 is a detail "F" of FIG. 31.
Figure 34:
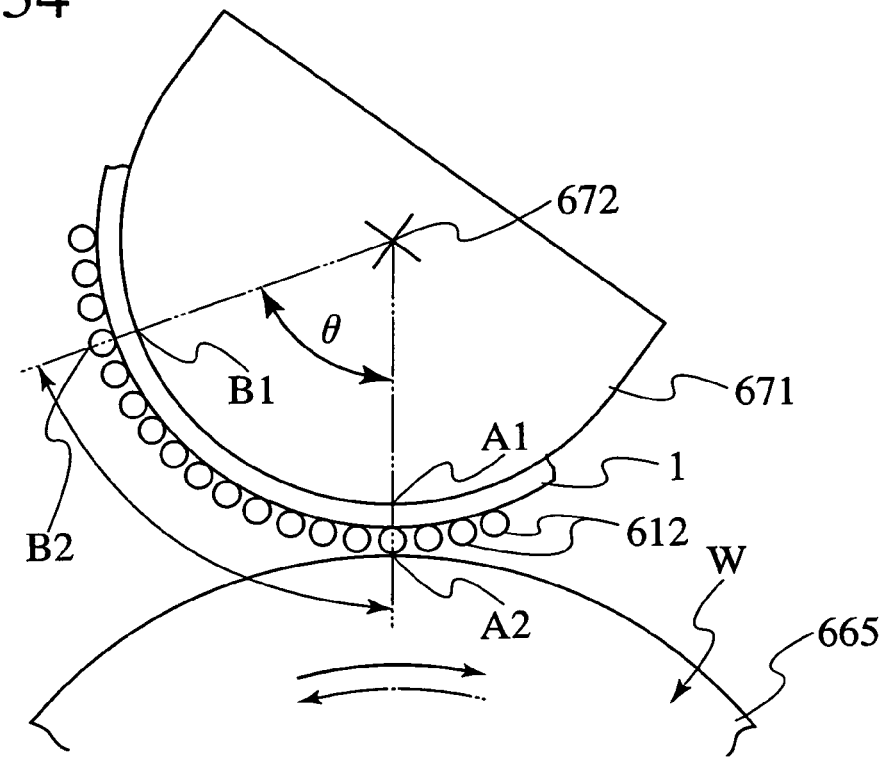
FIG. 34 is a rear view of an upper lap member of the lap of FIG. 31, as the member is swung CW (clockwise)
Figure 35:
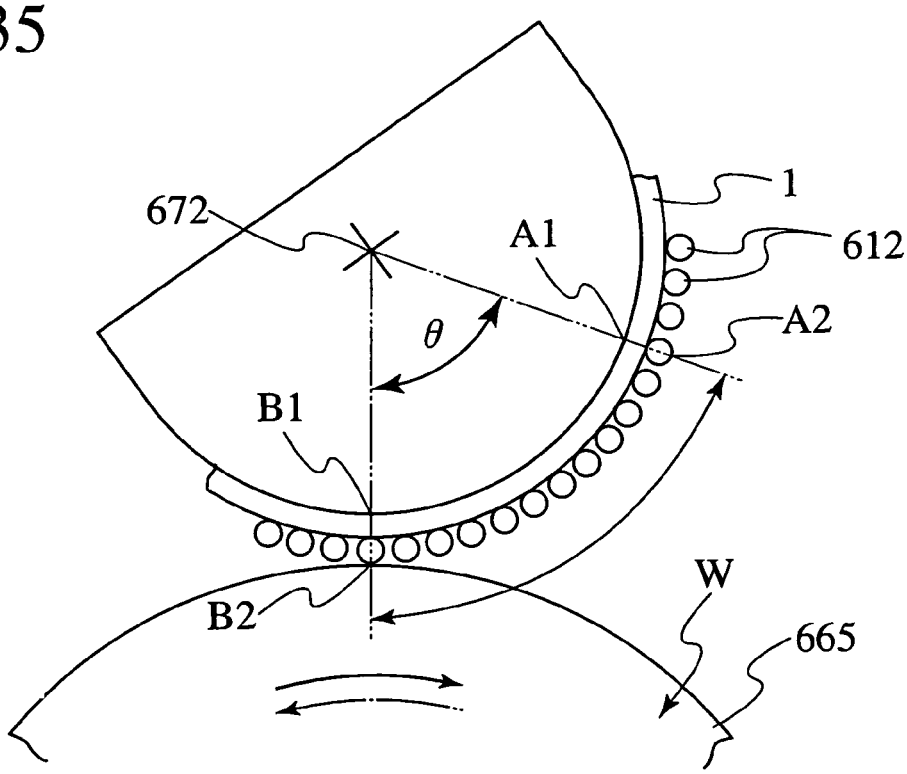
FIG. 35 is a rear view of the upper lap member swung CCW (counterclockwise)
Figure 36:
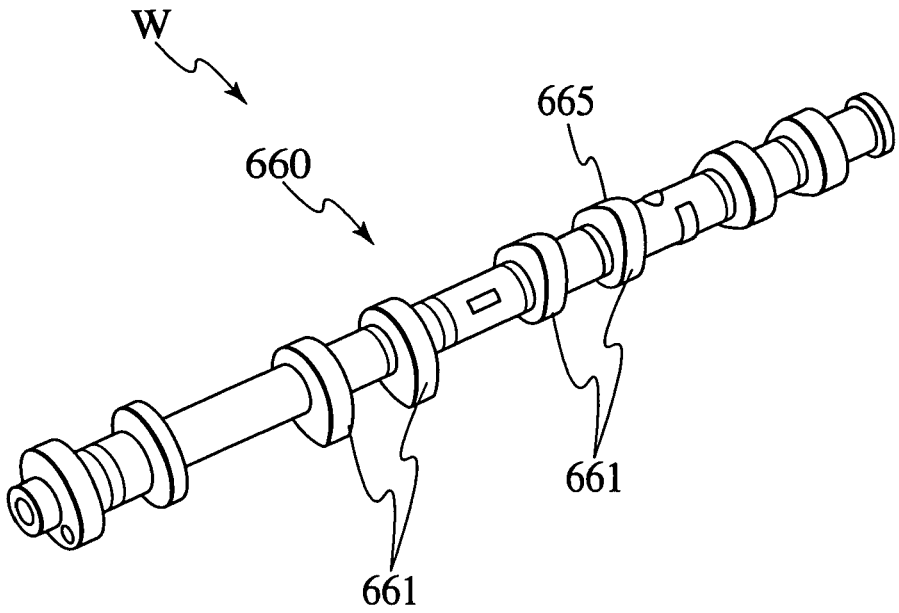
FIG. 36 is a perspective view of a work of the apparatus of FIG. 30.
Figure 37:
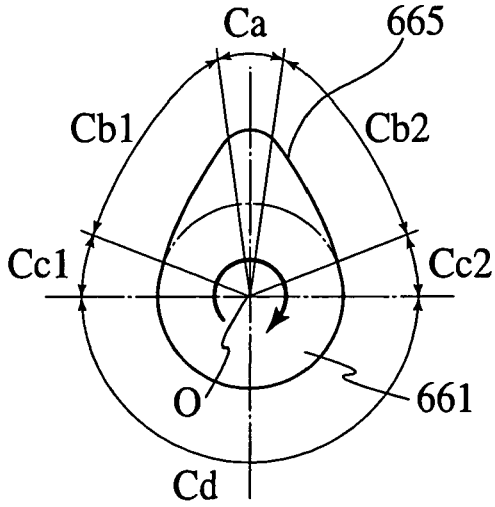
FIG. 37 is a cross section of the work at the lap of FIG. 31.
Figure 38:
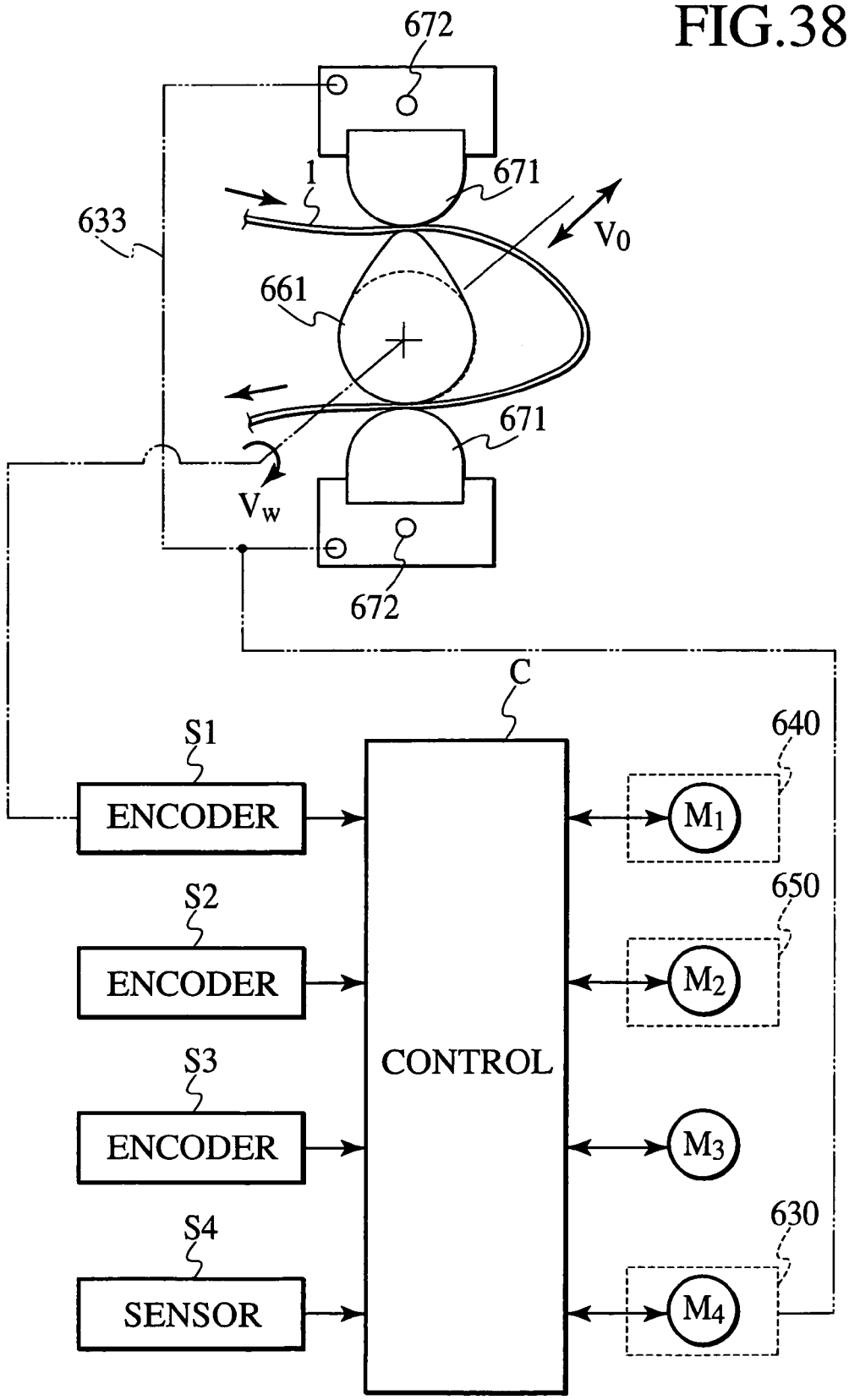
FIG. 38 is a diagram of a control system of the lap of FIG. 31.

Description is now made of a sixth embodiment of the invention, with reference to FIG. 30 to FIG. 37. FIG. 30 shows a lapping apparatus 600 according to the sixth embodiment, FIG. 31, a close state of a lap 600-j of the apparatus 600, and FIG. 32, an open state of the lap 600-j. FIG. 33 is a detail "F" of FIG. 31. FIG. 34 shows the upper lap member 671 swung CW, and FIG. 35, the upper lap member 671 swung CCW. FIG. 36 and FIG. 37 show a camshaft 660 as a work W. FIG. 38 shows a control system of the lap 600-j.

With Reference to FIGS. 30 to 33, especially, a lapping apparatus 600 of the present embodiment is provided with convex shoes 671, 671 that are held to push the abrasive surface of the lapping film 1, which is flexible but not expansive, against the work W and operative to exhibit floating motions for swinging heads thereof and a floating unit 630 (floating means) that causes the shoes 671, 671 to be in the floating motions in correspondence with a rotation of the work W, for thereby executing a lapping process while pressing the lapping film 1 against a surface 665 of the work W to be lapped. The floating unit 30 includes driving means 631 connected with the shoes 671, 671 to cause the shoes 671, 671 to forcedly generate the floating motions.

As the work W, shown in FIG. 36, a camshaft 660 is applicable, and an outer peripheral surface of each cam lobe 661 is the surface 665 to be lapped. As shown in FIG. 37, the cam lobe 661 is comprised of portions Ca, Cb1, Cb2, Cc1, Cc2 and Cd to be lapped, and the base portion Cd has a constant radius of curvature, the event portions Cb1, Cb2 have linear peripheries and the top portion Ca has a relatively small radius of curvature. That is, the surface 665 of the cam lobe 661 is formed with an out-of-round shape in which a radius from the rotational center varies.

As shown in FIGS. 31 and 32, the pair of the upper arm 11 and the lower arm 12 are rotatably provided via the pin 14 in such a manner that their distal portions to which the shoes 671, 671 are attached are operative to relatively open and close along Z-direction. That is, the pivotal motions of the upper arm 11 and the lower arm 12 are executed with the lapping film 1, and when the upper arm 11 and the lower arm 12 are in the opening motion, the shoes 671, 671 become abutted with the cam lobe 661 intervening the lapping film 1, on the contrary when the upper arm 11 and the lower arm 12 are in the closing motion, the abutment between the shoes 671, 671 and the cam lobe 661 intervening the lapping film 1 is released.

As shown in FIGS. 34 and 35, the shoes 671, 671 have convex distal ends having convex circular shapes in cross sections for pushing the abrasive surface of the lapping film 1 to the work W. In the presently filed embodiment, the shoes 671, 671 are operative to exhibit the floating motions with the contact points or patches that are to be contact via the lapping film 1 with the surface 665 of the cam lobe 661 to be lapped are variable. Incidentally, the term "contact" means here that the shoes 671, 671 is abutted with the peripheral surface of the work W intervening the lapping film 1.

The shoes 671, 671 are respectively held in shoe cases 673, 673 to be operative to exhibit floating motions for swinging the heads thereof with swinging pins (support axes) 672, 672 that are located on a line passing through a central axis O of the cam shaft 60. The shoe cases 673, 673 are respectively contained in concave portions 627, 627 formed in the upper arm 11 and the lower arm 12 to be retractable against the work W. The shoe cases 673, 673 are respectively movable while guiding outer surfaces thereof by inner surfaces of the concave portions 627, 627. To back surfaces of the shoe cases 673, 673, springs 674, 674 each comprised of a compressed coil spring for work clamping are respectively provided to press the shoes 671, 671 against the surface 665 to be lapped via the lapping film 1.

The floating unit 630, as shown in FIG. 33, is provided with a link mechanism 633 connected with an operational rod 632 and a motor M4. A sensor S4 is provided to sense a moving position of the operational rod 632 to detect a floating position of each shoe 671. With the operational rod 632, the link mechanism 633 and the motor M4, the driving mechanism 631 is constituted. Incidentally, initial positions of the shoes 671, 671 are defined as the positions thereof as shown in FIG. 33.

Directions of the floating motions of the shoes 671, 671 are arbitrarily combined with one another. For example, if the upper shoe 671 exhibits the floating motion in a clockwise direction about the swinging pin 672 from its initial position, the lower shoe 671 may exhibit the floating motion in a clockwise or counterclockwise direction about the swinging pin 672 from its initial position.

With reference to FIGS. 34 and 35, a function of each shoe 671 operative to be in the floating motion while swinging the head thereof is described in detail. In FIG. 34, the shoe 671 that exhibits the floating motion in the clockwise direction at maximum from the initial position thereof is shown, and in FIG. 35, the shoe 671 that exhibits the floating motion in the counterclockwise direction at maximum from the initial position thereof is shown. Incidentally, in FIGS. 34 and 35, abrasive particles are shown with a numeral 612.

As shown in FIG. 34, when the shoe 671 exhibits the floating motion in the clockwise direction at maximum from the initial position thereof, the pushed shoe 671 and a back surface of the lapping film 1 are in pressure-contact with each other on a point A1, and the abrasive surface of the lapping film 1 and the work W are in pressure-contact with each other on a point A2. On the other hand, as shown in FIG. 35, when the shoe 671 exhibits the floating motion in the counterclockwise direction at maximum from the initial position thereof, since the shoe 671 and the lapping film 1 are not slipped to one another, the pushed shoe 671 and the back surface of the lapping film 1 are in pressure-contact with one another on a point B1, and the abrasive surface of the lapping film 1 and the work W are in pressure-contact with one another on a point B2.

Accordingly, the contact points between the shoe 671 and the lapping film 1 are dispersed within a range between the contact points A1 and B1. In addition, the contact points between the lapping film 1 and the work W are dispersed within a range between the contact points A2 and B2. If a head swinging angle, in each of the clockwise direction and the counterclockwise direction, from the initial position is set as an angle $\alpha$, this range to be defined with an angle $\theta$ about the swinging pin 72 as a center is expressed as $\theta=2\alpha$.

In such a manner, during the lapping processing, since the contact points between each shoe 671 and the lapping film 1 are dispersed in a certain range, the shoe pushing force is not concentrated on one point of the shoe 671, and thus, the shoe 671 is free from being locally heavily damaged. Further, since the contact points between the lapping film 1 and the work W are dispersed in a certain range, the shoe pushing force is not concentrated on one point of the lapping film 1, and thus, blocking of the lapping film 1 and abruption of the abrasive particles 612 are free from being locally heavily developed.

FIG. 38 is a schematic block diagram showing a controlling system of the lapping apparatus 600.

With reference to FIG. 38, rotary encoders S1 to S3, the sensor S4 are connected to the controller (controlling means) C, and detected signals regarding a rotational position of the cam lobe 661 during the lapping processing and a moving position of the operational rod 632 to define the floating position of the shoes 671, 671 are input to the controller C. Further, detected signals regarding a rotational speed of the motor M1 to define a work rotation speed Vw and a rotational speed of the motor M2 to define an oscillation speed Vo are input to the controller C. The controller C controls to allow the shoes 671, 671 to exhibit the floating motion in response to the rotational position of the cam lobe 661 detected by the rotary encoder S1.

The control to vary the floating motions of the shoes 671, 671 is executed by controlling the operation of the driving means 631 of the floating unit 630 in such a manner that the contact points between the shoes 671, 671 and the lapping film 1 and those between the lapping film 1 and the work W are varied in response to the rotational position of the cam lobe 661 during the lapping process.

More particularly, the controller C sends a controlling signal to control the rotation of the motor M4 to control the operational rod 632, in response to the rotational position of the cam lobe 661 during the lapping process, to retractably move, and in response to this effect, to operate the link mechanism 633 such that the shoes 671, 671 respectively exhibit the floating motions about the swinging pins 672, 672. Due to this, the contact points between each shoe 671 and the lapping film 1 are dispersed within a certain range (e.g., a range between the contact points A1 and B1 shown in FIG. 34), and also, the contact points between the lapping film 1 and the work W are dispersed within a certain range (e.g., a range between the contact points A2 and B2 shown in FIG. 35).

Next, an operation of the abovementioned lapping apparatus 600 of the present embodiment is described in detail.

At first, in the same manner as the previously described embodiments, the camshaft 660 is set between the head stock 22 and the tail stock 25 and then the pair of the upper arm 11 and the lower arm 12 are closed in alignment with each cam lobe 661 while setting the lapping film 1 on the surface 665 of the cam lobe 661.

Then, while preferably applying tension to the lapping film 1 and clamping the camshaft 660, the shoes 671, 671 are pushed to the cam lobe 661 by the urged force of the spring 74 and the abrasive surface of the lapping film 1 is pushed to the surface 665 to be lapped.

Then, while applying the oscillation to the camshaft 660 in the axial direction thereof by operating the oscillation unit 30 and rotating the camshaft 660 about the center axis thereof by operating the rotational driving unit 20, the shoe cases 673, 673 respectively holding the shoes 671, 671 are retractedly moved in accordance with the rotations of the cam lobes 661, and thus, the surface 665 of each cam lobe 661 is lapped.

During such lapping process, the rotary encoder S1 detects the rotational position of each cam lobe 661, and the controller C controls the shoes 671, 671 to exhibit the floating motions in response to the detected rotational position of the cam lobe 661. That is, the controller C controls the motor M4 to retract the operational rod 632, in response to this, to actuate the link mechanism 633, and to cause the shoes 671, 671 to exhibit the floating motions about the swinging pins 672, 672 as the centers.

Resultantly, the contact points between each shoe 671 and the lapping film 1 are dispersed in a certain range, and the contact points between the lapping film 1 and the work W are dispersed in a certain range.

During the lapping process, the camshaft 660 is positively rotated with preset times (e.g., five times) and thereafter negatively rotated with the same times. By changing the rotational direction of the camshaft 660, the blocking of the lapping film 1 is eliminated and its performance is maintained.

In such a manner, during the lapping processing, since the contact points between each shoe 671 and the lapping film 1 are dispersed in a certain range, the shoe pushing force is not concentrated on one point of the shoe 671, and thus, the shoe 671 can be free from being locally heavily damaged.

Further, since the contact points between the lapping film 1 and the work W are dispersed in a certain range, the shoe pushing force is not concentrated on one point of the lapping film 1, and thus, blocking of the lapping film 1 and abruption of the abrasive particles 612 are free from being locally heavily developed. This means that, in taking a view of a work volume of the lapping film 1, since the work surface is dispersed, the work volume is increased. Therefore, due to the increase of the work volume of the lapping film 1, the lapped surface 665 has improved finished roughness and the process time can be reduced.

Although the camshaft 660 has the plurality of cam lobes 661, the lapping process is simultaneously carried out over whole of the plurality of cam lobes 661. After completing the lapping process, the pair of the upper arm 11 and the lower arm 12 are opened and the camshaft 660 is taken out. Sequentially, if desired, the next the camshaft 660 as the work W is set in lapping apparatus 600 with the same manner.

As above described, in the lapping apparatus 600 of the present embodiment, there are provided the lapping film 1, the shoes 671, 671 including the convex distal ends having convex circular shapes in cross sections for pushing the abrasive surface of the lapping film 1 to the work W and held in shoe cases 673, 673 to be operative to exhibit floating motions for swinging the heads thereof with swinging pins 672, 672 and the floating unit 630 rotating the shoes 671, 671 in response to the rotation of the work W in such a manner that the contact points between each shoe 671 and the lapping film 1 are dispersed in a certain range and the contact points between the lapping film 1 and the work W are dispersed in a certain range. Therefore, the shoes 671, 671 can be free from being locally heavily damaged and the blocking of the lapping film 1 and abruption of the abrasive particles 612 can be free from being locally heavily developed. Also, due to the increase of the work volume of the lapping film 1, the lapped surface 665 has improved finished roughness and the process time can be reduced.

In addition, the floating unit 630 includes driving means 631 connected with the shoes 671, 671 to cause the shoes 671, 671 to forcedly generate the floating motions, and also, there is provided the controller C that controls the driving means 631 to vary the floating motions of the shoes 671, 671 in such a manner that the contact points between the shoes 671, 671 and the lapping film 1 and those between the lapping film 1 and the work W are varied in response to the rotational position of the cam lobe 661 during the lapping process. Therefore, additionally, the range in which the contact points are dispersed can be arbitrarily and beneficially set.

Incidentally, since the lapping film 1 is flexible but not expansive, the preferable lapping process can be performed with the work W.

Modification of Sixth Embodiment

Figure 39:
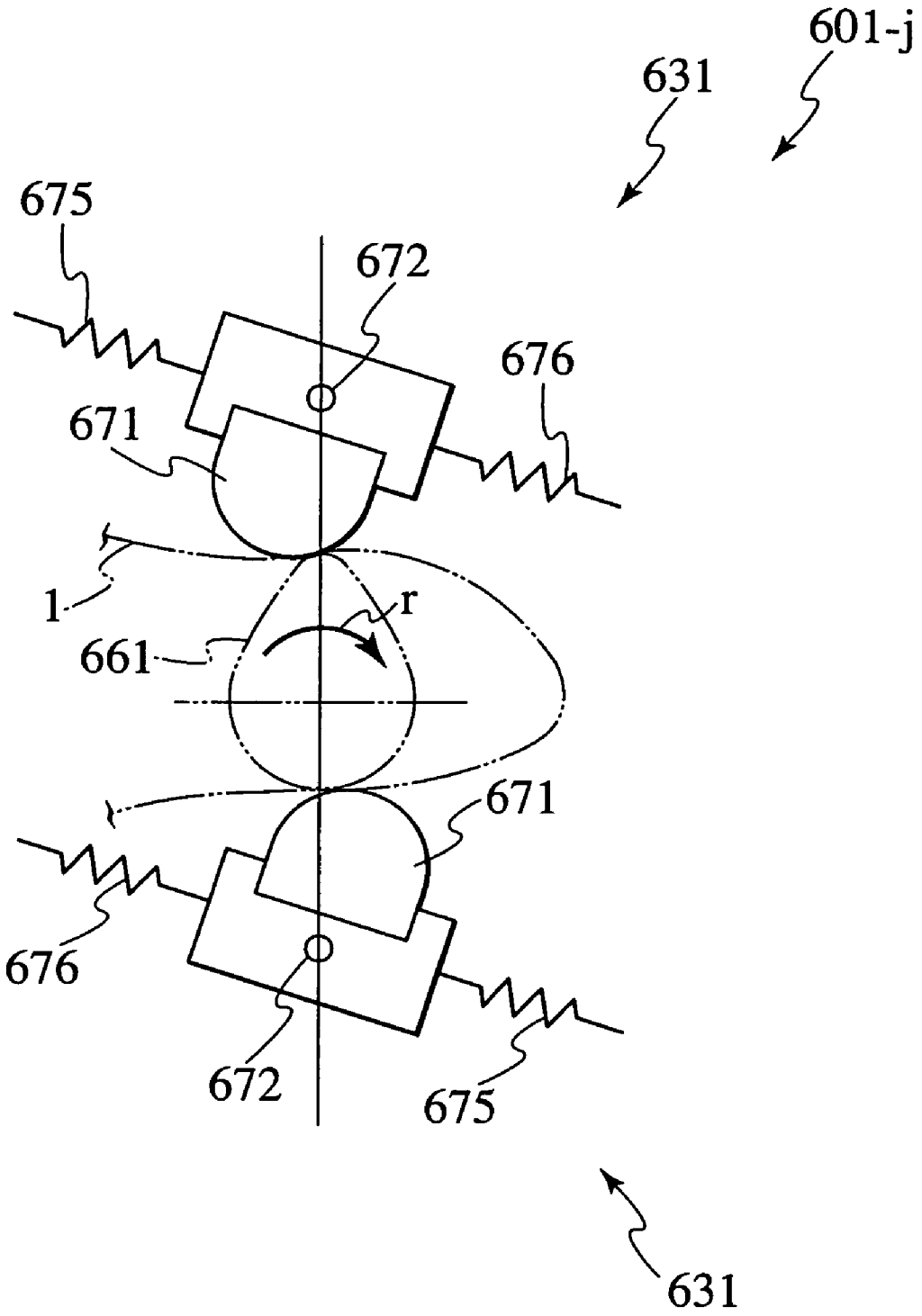
FIG. 39 is a rear view of a lap of a lapping apparatus according to a modification of the sixth embodiment.
Figure 40A:
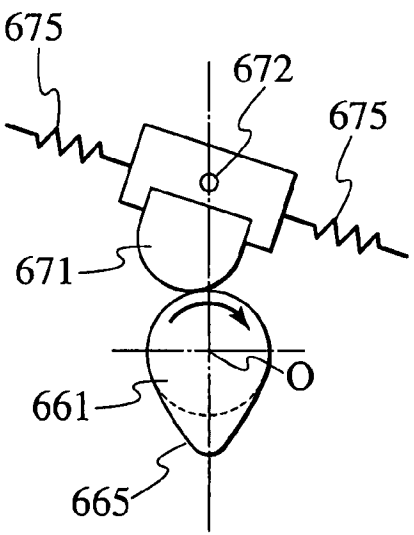
FIGS. 40A to 40D are rear views of an upper lap of the lap of FIG. 39, as the upper lap is floating to trace a work.
Figure 40B:
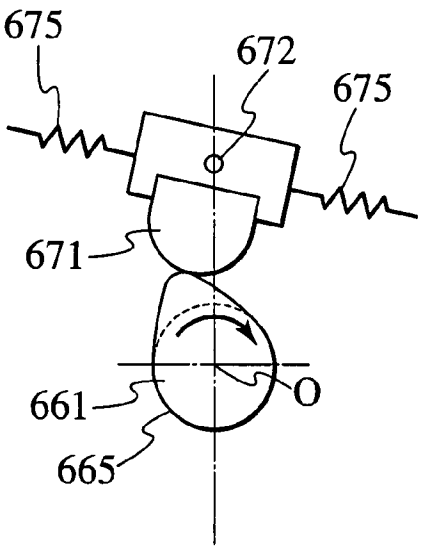
Figure 40C:
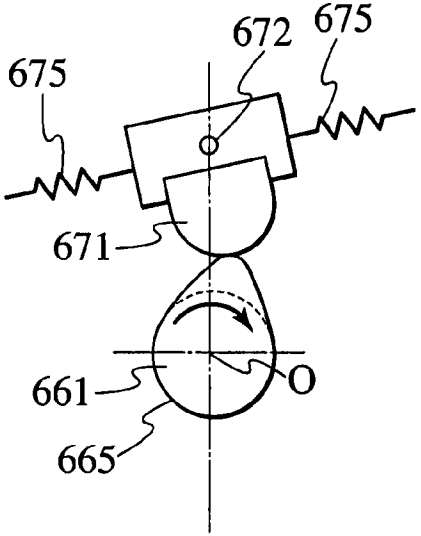
Figure 40D:
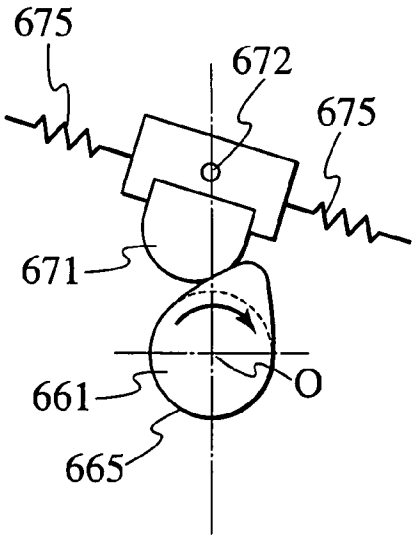

FIG. 39 shows upper and lower floating units 631 of a lap 601-j of a lapping apparatus according to a modification of the sixth embodiment, and FIGS. 40A to 40D, the upper floating unit 631 floating to trace a work W.

This lapping is suitable for lapping the work rotated along only one direction. This lapping apparatus includes a convex shoe 671 and a floating unit 631. The convex shoe 671 is formed into a convex one, has a convex tip end portion to push the abrasive-particleed surfaces of a lapping film to the work, and is held to perform a floating motion. The floating unit 631 causes the convex shoe 671 to perform the floating motion according to a rotation of the work.

As shown in FIG. 39, the floating unit 631 includes a pair of spring members 675, 676 for applying a reactive elastic force to the convex shoe 671 in the floating direction. The force applied by a pair of spring members 675, 676 functions to float the convex shoe 671 in the direction opposite to a rotating direction of the work. That is, in the case the work rotates clockwise as indicated by arrows, the force applied by the pair of spring members 675, 676 functions to float the upper convex shoe 671 to the left, and to float the lower convex shoe 671 to the right.

The spring members 675, 676 have different spring constants to apply the above-mentioned force to the convex shoe 671. For example, in the case the spring members 675, 676 are constituted by a coil spring, a spring constant of the spring member 675 is larger than that of the spring member 676. In the case the spring members 675, 676 are constituted by a compression coil spring, a spring constant of the spring member 676 is larger than that of the spring member 675.

The camshaft 660 is rotated around its axis by operating the rotational driving unit 40 while applying oscillation to the camshaft 660 along the axial direction by operating the oscillation unit 30, so that the shoe cases 673 holding the shoes 671 advance and retract within the concaves 27 in a manner to follow the rotation of the applicable cam lobe portions 661, respectively, thereby lapping the pre-machined surfaces 665 of the cam lobe portions 661.

As shown in FIGS. 40A through 40D, when the work W is being lapped, the work W rotates only clockwise as indicated by arrows. The force applied by a pair of spring members 675, 676 acts to float the convex shoe 671 in the direction opposite to a rotating direction of the work.

In accordance with the rotation of work W, the convex shoe 671 floats toward the right direction in FIGS. 40A through 40D. When a machined portion of the work W is moved from a top region to an event region, the convex shoe 671 floats toward the left direction in FIGS. 40A through 40D by a function of the spring member 675. (see FIG. 40D).

Thus, a contact point between the convex shoe 671 and the lapping film 1 is dispersed in a constant region, and a contact point between the lapping film 1 and the work W is dispersed in the constant region, thereby reducing a local damage of the convex shoe 671, a blocking of the lapping film 1, and a separation of abrasive particles.

In the embodiment described, since the driving mechanism 631 of the floating unit 630 forces the convex shoe 671 to swing in a floating manner, swing motion of the convex shoe 671 can be precisely controlled for various rotational positions of the work W during machining. For example, for the cam lobe portion 661, which requires very fine surface roughness for finishing the top region Ca and the event regions Cb1 and Cb2, the convex shoe 671 may be controlled to swing in a floating manner only while the work W stays in a rotational position where the top region Ca or the event regions Cb1 and Cb2 is/are machined. The convex shoe 671 may be controlled to swing in a floating manner while the work W makes one revolution, or for a limited time while the work W rotates a predetermined range of rotation angle.

Although the driving mechanism 631 of the floating unit 630 described is constituted with the rod 632, the link mechanism 633, the motor M4 and the like, the driving mechanism 631 may be constituted of other components. For example, a fluid pressure cylinder, such as a hydraulic cylinder or a pneumatic cylinder, may be used for having the convex shoe 671 forcibly swung in a floating manner. A plurality of convex shoes 671 (the upper shoe and the lower shoe in the example shown) may be independently connected to the driving mechanism 631.

Although, the resilient members 675 and 676 included in the floating unit 630 are constituted with coil springs, the resilient members 675 and 676 may be constituted with other materials, such as leaf springs, disk springs, and resilient rubber material, as long as the resilient member can exert a force onto the convex shoe 671 to have the convex shoe 671 swing in a floating manner in an opposite direction to the direction of rotation of the work W.

The contents of Japanese Patent Application Nos. 2003-058954, 2003-034088, 2003-066595, 2003-036701, 2003-058964, and 2003-034064 are incorporated herein by reference.

While preferred embodiments of the present invention have been described using specific terms, such description is for illustrative purposes, and it is to be understood that changes and variations may be made by the artisan without departing from the spirit or scope of the following claims.

What is claimed is:

1. A lapping apparatus comprising:

a lapping film;

a film feeder configured to feed the film;

a first drive configured to rotate a work;

a second drive configured to move the work relative to the film;

a shoe set comprising a first shoe of a width and a second shoe of the same width spaced apart from each other by a distance of the width times an integer;

wherein the film feeder is configured to feed the film by an amount of the distance;

a shoe set handler configured to handle the shoe set to press the film against the work; and a deterioration delayer configured to delay an abrasivity deterioration of the film.

2. The lapping apparatus as claimed in claim 1, wherein the deterioration delayer comprises a controller configured to control the film feeder to feed the film by an amount of the distance.

3. The lapping apparatus as claimed in claim 2, wherein the shoe set comprises a number of shoes equal to the integer.

4. The lapping apparatus as claimed in claim 2, wherein the shoe set comprises a first shoe set, and a second shoe set, and the deterioration delayer comprises a detector configured to detect a condition of an abrasive face of the film between the first shoe set and the second shoe set, and the controller is configured to control the film feeder in dependence on the condition detected by the detector.

5. The lapping apparatus as claimed in claim 1, wherein the shoe set comprises a first shoe set, and a second shoe set, and the deterioration delayer comprises a cleaner configured to clean an abrasive face of the film between the first shoe set and the second shoe set.

6. The lapping apparatus as claimed in claim 5, wherein the deterioration delayer comprises a film warper configured to warp the film with the abrasive face outside.

7. The lapping apparatus as claimed in claim 5, wherein the cleaner comprises an ultrasonic brush.

8. The lapping apparatus as claimed in claim 5, wherein the cleaner comprises an ultrasonic bath.

9. The lapping apparatus as claimed in claim 5, wherein the cleaner comprises a jet nozzle.

10. The lapping apparatus as claimed in claim 5, wherein the film comprises a flexible and non-expansive substrate.

11. The lapping apparatus as claimed in claim 1, wherein the deterioration delayer comprises a first detour provider configured to provide the film with a first detour defining a first space between the first shoe and the second shoe, and a lubricant supplier configured to supply a lubricant to the first space.

12. The lapping apparatus as claimed in claim 11, wherein the film comprises a flexible and non-expansive substrate.

13. The lapping apparatus as claimed in claim 11, wherein the shoe set comprises a third shoe, the deterioration delayer comprises a second detour provider configured to provide the film with a second detour defining a second space between the second shoe and the third shoe, and the lubricant supplier is configured to supply the lubricant to the second space.

14. The lapping apparatus as claimed in claim 11, wherein the first detour provider comprises a tension roller configured for the first detour to detour therearound, and a bias element configured to bias the tension roller in a detoured direction of the first detour.

15. The lapping apparatus as claimed in claim 14, wherein the tension roller is rotatable.

16. The lapping apparatus as claimed in claim 11, wherein the deterioration delayer comprises a shoe case having a first support part configured to support the first shoe, and a second support part configured to support the second shoe, the first and second support parts extending in radial directions of the work defining therebetween a slot configured to accommodate the first detour and the first detour provider resiliently suspended from the shoe case.

17. The lapping apparatus as claimed in claim 16, wherein the lubricant supplier comprises a network of lubricant paths formed in the shoe case and communicating with the first space.

18. The lapping apparatus as claimed in claim 11, wherein the lubricant supplier is configured to deliver the lubricant from around the first detour provider.

19. The lapping apparatus as claimed in claim 1, wherein the deterioration delayer comprises a film detector configured to detect a condition of an abrasive face of the film, and a controller configured to control one of the film feeder and the shoe set handler depending on the condition detected.

20. The lapping apparatus as claimed in claim 19, wherein the condition detected comprises a projection of an abrasive particle of the abrasive face.

21. The lapping apparatus as claimed in claim 19, wherein the deterioration delayer comprises a truer configured to true the abrasive face depending on the condition detected.

22. The lapping apparatus as claimed in claim 19, wherein the film detector is configured to detect the condition of the abrasive face before a lapping service.

23. The lapping apparatus as claimed in claim 19, wherein the film detector is configured to detect the condition of the abrasive face after a lapping service.

24. The lapping apparatus as claimed in claim 1, wherein the deterioration delayer comprises a blocking delayer configured to delay a blocking of the film.

25. A lapping apparatus comprising:

a lapping film;

film feeding means for feeding the film;

first drive means for rotating a work;

second drive means for moving the work relative to the film;

a shoe set comprising a first shoe of a width and a second shoe of the same width spaced apart from each other by a distance of the width times an integer;

wherein the film feeding means is configured to feed the film by an amount of the distance;

shoe set handling means for handling the shoe set to press the film against the work; and deterioration delaying means for delaying an abrasivity deterioration of the film.

26. A lapping method comprising:

feeding a lapping film;

rotating a work;

moving the work relative to the film;

handling a shoe set to press the film against the work, wherein the shoe set comprises a first shoe of a width and a second shoe of the same width spaced apart from each other by a distance of the width times an integer;

feeding the film by an amount of the distance; and delaying an abrasivity deterioration of the film.

27. The lapping method as claimed in claim 26, wherein the shoe set comprises a number of shoes equal to the integer.

28. The lapping method as claimed in claim 26, wherein the shoe set comprises a first shoe set, and a second shoe set, and the delaying comprises detecting a condition of an abrasive face of the film between the first shoe set and the second shoe set, and the feeding depends on the condition detected.

29. The lapping method as claimed in claim 26, wherein the shoe set comprises a first shoe set, and a second shoe set, and the delaying comprises cleaning an abrasive face of the film between the first shoe set and the second shoe set.

30. The lapping method as claimed in claim 26, wherein the delaying comprises providing the film with a detour defining a space between the first shoe and the second shoe, and supplying a lubricant to the space.

31. The lapping method as claimed in claim 26, wherein the delaying comprises detecting a condition of an abrasive face of the film, and controlling one of feeding and handling depending on the condition detected.

* * * * *